US008489008B2

(12) United States Patent
Iwaya et al.

(10) Patent No.: US 8,489,008 B2
(45) Date of Patent: Jul. 16, 2013

(54) FIXING DEVICE AND IMAGE FORMING APPARATUS INCORPORATING SAME

(75) Inventors: Naoki Iwaya, Chofu (JP); Masaaki Yoshikawa, Tokyo (JP); Kenji Ishii, Kawasaki (JP); Hiroshi Yoshinaga, Ichikawa (JP); Tetsuo Tokuda, Kawasaki (JP); Yoshiki Yamaguchi, Sagamihara (JP); Ippei Fujimoto, Ebina (JP); Yutaka Ikebuchi, Chigasaki (JP); Takahiro Imada, Yokohama (JP); Takamasa Hase, Kawasaki (JP); Toshihiko Shimokawa, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 352 days.

(21) Appl. No.: 12/929,496

(22) Filed: Jan. 28, 2011

(65) Prior Publication Data

US 2011/0206427 A1 Aug. 25, 2011

(30) Foreign Application Priority Data

Feb. 25, 2010 (JP) ..... 2010-040255

(51) Int. Cl.
*G03G 15/20* (2006.01)

(52) U.S. Cl.
USPC ..... 399/329; 399/122

(58) Field of Classification Search
USPC .. 399/107, 110, 122, 320, 328, 329; 219/216, 219/619
See application file for complete search history.

(56) References Cited

U.S. PATENT DOCUMENTS

| | | | |
|---|---|---|---|
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,813,464 | B2 | 11/2004 | Amita et al. |
| 6,881,927 | B2 | 4/2005 | Yoshinaga et al. |
| 6,882,820 | B2 | 4/2005 | Shinshi et al. |

(Continued)

FOREIGN PATENT DOCUMENTS

| | | |
|---|---|---|
| CN | 101488002 | 7/2009 |
| CN | 101561654 | 10/2009 |

(Continued)

OTHER PUBLICATIONS

Chinese Office Action dated Jan. 18, 2013 issued in corresponding Chinese Application No. 2011-10038328.9.

*Primary Examiner* — Hoan Tran
(74) *Attorney, Agent, or Firm* — Harness, Dickey & Pierce, P.L.C.

(57) ABSTRACT

A fixing device includes an endless fuser belt, a contact member, a pressure member, a heater, a heater support, and a belt tensioner. The endless fuser belt is looped into a generally cylindrical configuration extending in an axial direction thereof. The contact member extends in the axial direction inside the loop of the fuser belt. The pressure member extends in the axial direction with the belt interposed between the contact member and the pressure member. The pressure member is pressed against the contact member through the fuser belt to form a fixing nip. The heater is disposed inside the loop of the fuser belt to heat the fuser belt. The heater support is disposed inside the loop of the fuser belt to hold the heater in position. The belt tensioner is disposed inside the loop of the fuser belt to tighten the fuser belt.

14 Claims, 9 Drawing Sheets

U.S. PATENT DOCUMENTS

| | | | | |
|---|---|---|---|---|
| 6,892,044 | B2 | 5/2005 | Yasui et al. | |
| 6,937,827 | B2 | 8/2005 | Katoh et al. | |
| 6,975,829 | B2 * | 12/2005 | Aruga | 399/329 |
| 7,022,944 | B2 | 4/2006 | Yoshinaga et al. | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 * | 12/2007 | Satoh et al. | 399/329 |
| 7,344,615 | B2 | 3/2008 | Sato et al. | |
| 7,379,698 | B2 | 5/2008 | Yoshinaga | |
| 7,437,111 | B2 | 10/2008 | Yamada et al. | |
| 7,454,151 | B2 | 11/2008 | Satoh et al. | |
| 7,466,949 | B2 | 12/2008 | Satoh et al. | |
| 7,509,085 | B2 | 3/2009 | Yoshinaga et al. | |
| 7,546,049 | B2 | 6/2009 | Ehara et al. | |
| 7,570,910 | B2 | 8/2009 | Ishii | |
| 7,702,271 | B2 | 4/2010 | Yamada et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,840,151 | B2 | 11/2010 | Fujimoto | |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0165348 | A1 | 9/2003 | Amita et al. | |
| 2003/0183610 | A1 | 10/2003 | Okabayashi et al. | |
| 2003/0206758 | A1 | 11/2003 | Yasui et al. | |
| 2003/0215271 | A1 | 11/2003 | Yoshinaga et al. | |
| 2004/0013453 | A1 | 1/2004 | Shinshi et al. | |
| 2005/0025539 | A1 | 2/2005 | Yoshinaga | |
| 2005/0074251 | A1 | 4/2005 | Katoh et al. | |
| 2005/0095043 | A1 | 5/2005 | Yoshinaga et al. | |
| 2005/0163543 | A1 | 7/2005 | Satoh et al. | |
| 2005/0180786 | A1 | 8/2005 | Yamada et al. | |
| 2006/0029411 | A1 | 2/2006 | Ishii et al. | |
| 2006/0032581 | A1 | 2/2006 | Sato et al. | |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0165448 | A1 | 7/2006 | Yoshinaga | |
| 2006/0257183 | A1 | 11/2006 | Ehara et al. | |
| 2006/0285893 | A1 | 12/2006 | Ishii | |
| 2007/0014600 | A1 | 1/2007 | Ishii et al. | |
| 2007/0014603 | A1 | 1/2007 | Satoh et al. | |
| 2008/0063443 | A1 | 3/2008 | Yoshinaga et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2008/0253789 | A1 | 10/2008 | Yoshinaga et al. | |
| 2008/0317532 | A1 | 12/2008 | Ehara et al. | |
| 2009/0003867 | A1 | 1/2009 | Fujimoto | |
| 2009/0010687 | A1 | 1/2009 | Yamada et al. | |
| 2009/0067902 | A1 | 3/2009 | Yoshinaga et al. | |
| 2009/0123201 | A1 | 5/2009 | Ehara et al. | |
| 2009/0123202 | A1 | 5/2009 | Yoshinaga et al. | |
| 2009/0148204 | A1 | 6/2009 | Yoshinaga et al. | |
| 2009/0148205 | A1 | 6/2009 | Seo et al. | |
| 2009/0169232 | A1 | 7/2009 | Kunii et al. | |
| 2009/0180821 | A1 | 7/2009 | Kagawa | |
| 2009/0245865 | A1 | 10/2009 | Shinshi et al. | |
| 2009/0245897 | A1 | 10/2009 | Seo et al. | |
| 2009/0252521 | A1 | 10/2009 | Takami | |
| 2009/0263170 | A1 | 10/2009 | Kagawa et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303521 | A1 | 12/2010 | Ogawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064451 | A1 | 3/2011 | Yamaguchi et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085832 | A1 | 4/2011 | Hasegawa et al. | |
| 2011/0116848 | A1 | 5/2011 | Yamaguchi et al. | |
| 2011/0129268 | A1 | 6/2011 | Ishii et al. | |
| 2011/0176822 | A1 | 7/2011 | Ishii et al. | |

FOREIGN PATENT DOCUMENTS

| | | | |
|---|---|---|---|
| JP | 04044075 | A | 2/1992 |
| JP | 08262903 | A | 10/1996 |
| JP | 10213984 | A | 8/1998 |
| JP | 3592485 | A | 1/1999 |
| JP | 2007334205 | A | 12/2007 |
| JP | 2008158482 | A | 7/2008 |
| JP | 2008-216928 | A | 9/2008 |
| JP | 2008310051 | A | 12/2008 |

* cited by examiner

FIXING DEVICE AND IMAGE FORMING APPARATUS INCORPORATING SAME

CROSS-REFERENCE TO RELATED APPLICATIONS

The present patent application claims priority pursuant to 35 U.S.C. §119 from Japanese Patent Application No. 2010-040255, filed on Feb. 25, 2010, which is hereby incorporated by reference herein in its entirety.

BACKGROUND OF THE INVENTION

1. Field of the Invention

The present invention relates to a fixing device and an image forming apparatus incorporating the same, and more particularly, to a fixing device that fixes a toner image in place on a recording medium with heat and pressure, and an electrophotographic image forming apparatus, such as a photocopier, facsimile machine, printer, plotter, or multifunctional machine incorporating several of those imaging functions, incorporating such a fixing device.

2. Description of the Background Art

In electrophotographic image forming apparatuses, such as photocopiers, facsimile machines, printers, plotters, or multifunctional machines incorporating several of those imaging functions, an image is formed by attracting toner particles to a photoconductive surface for subsequent transfer to a recording medium such as a sheet of paper. After transfer, the imaging process is followed by a fixing process using a fixing device, which permanently fixes the toner image in place on the recording medium by melting and settling the toner with heat and pressure.

Various types of fixing devices are known in the art, most of which employ a pair of generally cylindrical looped belts or rollers, one being heated for fusing toner ("fuser member") and the other being pressed against the heated one ("pressure member"), which together form a heated area of contact called a fixing nip through which a recording medium is passed to fix a toner image onto the medium under heat and pressure.

One such fixing device includes a multi-roller, belt-based fuser assembly that employs an endless fuser belt entrained around multiple rollers, paired with a pressure roller pressed against the outer surface of the fuser belt to form a fixing nip therebetween. The fuser belt is held on a heat roller equipped with an internal heater, which heats the length of the fuser belt through contact with the heat roller. At the fixing nip, a toner image on an incoming recording sheet is fixed in place with heat from the fuser belt and pressure from the pressure roller.

Another type of fixing device includes a film-based fuser assembly that employs a fuser belt formed of thin heat-resistant film cylindrically looped around a stationary, ceramic heater, which is paired with a pressure roller that rotates while pressing against the stationary heater through the fuser belt to form a fixing nip therebetween. At the fixing nip, the pressure roller rotates to advance the fuser belt together with an incoming recording sheet, while the stationary heater heats the recording sheet via the fuser belt, so that a toner image is fixed in place with heat from the stationary heater and pressure from the pressure roller.

Of the two types of fuser assembly described above, the film-based assembly is superior to its counterpart in terms of processing speed and thermal efficiency. Owing to the heat-resistant film which exhibits a relatively low heat capacity and therefore can be swiftly heated, the film-based fuser assembly eliminates the need for keeping the heater in a sufficiently heated state when idle, resulting in a shorter warm-up time and smaller amounts of energy wasted during standby, as well as a relatively compact size of the fuser assembly.

By contrast, the multi-roller belt fuser, although advantaged over a conventional roller-based fuser, involves a substantial warm-up time to heat the fixing nip to a temperature sufficient for fusing toner and first-print time to complete an initial print job upon activation, limiting its application to relatively slow imaging systems.

Overcoming the limitation of the belt-based fixing device, the film-based fixing device finds applications in high-speed, on-demand compact printers that can promptly execute a print job upon startup with significantly low energy consumption.

Although generally successful for its intended purpose, the fixing device using a thin film fuser also has drawbacks. One drawback is its vulnerability to wear, where the heat-resistant film has its inner surface repeatedly brought into frictional contact with the surface of the stationary ceramic heater. The frictionally contacting surfaces of the film and the heater readily chafe and abrade each other, which, after a long period of operation, results in increased frictional resistance at the heater/film interface, leading to disturbed rotation of the fuser belt, or increased torque required to drive the pressure roller. If not corrected, such defects can eventually cause failures, such as displacement of a printed image caused by a recording sheet slipping through the fixing nip, and damage to a gear train driving the fixing members due to increased stress during rotation.

Another drawback is the difficulty in maintaining a uniform processing temperature throughout the fixing nip. The problem arises where the fuser film, which is once locally heated at the fixing nip by the heater, gradually loses heat as it travels downstream from the fixing nip, so as to cause a discrepancy in temperature between immediately downstream from the fixing nip (where the fuser belt is hottest) and immediately upstream from the fixing nip (where the fuser belt is coldest). Such thermal instability adversely affects fusing performance of the fixing device, particularly in high-speed applications where the rotational fixing member tends to dissipate higher amounts of heat during rotation at a high processing speed.

The former drawback of the fixing device has been addressed by another conventional fixing device, which uses a lubricant, such as a low-friction sheet of fiberglass impregnated with polytetrafluoroethylene (PTFE), disposed between the contacting surfaces of a stationary pressure pad and a rotatable fixing belt. In this fixing device, the rotatable fixing belt is looped for rotation around the stationary pressure pad, while held in contact with an internally heated, rotatable fuser roller that has an elastically deformable outer surface. The pressure pad is spring-loaded to press against the fuser roller through the fixing belt, which establishes a relatively large fixing nip therebetween as the fuser roller elastically deforms under pressure.

According to this arrangement, provision of the lubricant sheet prevents abrasion and chafing at the interface of the stationary and rotatable fixing members, as well as concomitant defects and failures of the fixing device. Moreover, the relatively large fixing nip translates into increased efficiency in heating a recording sheet by conduction from the fuser roller, which allows for designing a compact fixing device with reduced energy consumption.

However, the conventional method does not address the thermal instability caused by locally heating the fixing belt at the fixing nip, as is the case with the conventional fixing device. Further, this method involves a fixing roller that exhibits a relatively high heat capacity and therefore takes time to heat up to a desired processing temperature, leading to a longer warm-up time. Hence, although designed to provide an increased thermal efficiency through use of an elastically deformable fuser roller, the conventional method fail to provide satisfactory fixing performance for high-speed, on-demand applications.

To cope with the problems of the fixing device using a cylindrically looped, rotatable fixing belt, several methods have been proposed.

For example, one conventional method proposes a fuser assembly that employs a stationary tubular belt holder of thermally conductive material around which a fuser belt is retained in its generally cylindrical shape. The belt holder is equipped with a resistive heater such as a ceramic heater disposed inside the tube so as to heat the entire length of fuser belt rotating around its circumference.

According to this method, the thermal belt holder, which is formed by bending a thin sheet of metal into a tubular configuration, can swiftly conduct heat to the fuser belt, while guiding substantially the entire length of the belt along the outer circumference thereof. Compared to a stationary heater or heated roller that locally heats the fuser belt or film solely at the fixing nip, using the thin-walled conductive belt holder allows for heating the fuser belt swiftly and uniformly, resulting in shorter warm-up times which meet high-speed, on-demand applications.

One drawback encountered when using a tubular belt holder to heat a fuser belt is the difficulty in maintaining uniform spacing between the fuser belt and the belt holder. That is, the elastic fuser belt during rotation occasionally moves too far from the surface of the belt holder to conduct appropriate amounts of heat from the belt holder to the fuser belt. The lack of conduction can cause the metal-based belt holder to locally overheat and burn, resulting in an increased torque of the fuser belt rotating along the damaged surface.

Another conventional method employs a cylindrically looped fuser belt paired with a pressure roller pressed against the fuser belt to form a fixing nip, as well as a stationary, resistive heater in the form of a thin-walled pipe of metal that exhibits a certain resistivity to generate heat when electrified. The resistive heater is installed within the loop of fuser belt with a small spacing in a radial direction, so that their adjoining surfaces do not press against each other, and radiates heat over the entire length of the fuser belt rotating around the metal pipe.

According to this method, holding the fuser belt in close proximity with the resistive heater allows for good imaging performance at high processing speeds, which results in shorter warm-up time and first-print time of the belt-based fixing device. Moreover, keeping the fuser belt and the resistive heater slightly apart prevents abrasion and other concomitant failure of the fuser belt and the resistive heater in high-speed applications.

One drawback of this method is that the flexible fuser belt suffers from variations in temperature as it occasionally contacts or moves away from the surface of the resistive heater, as is the case with the one entrained around the tubular belt holder described above. In particular, the fuser belt can locally overheat where the fuser belt, disposed in close proximity with the resistive heater for obtaining high thermal efficiency, contacts the heater to conduct excessive amounts of heat therebetween. Such localized heating of the fuser belt results in poor imaging performance due to non-uniform distribution of heat across the fixing nip.

Another drawback is that the resistive heater can wear and break as it undergoes repeated flexion or stress caused by rotational vibration transmitted from the pressure roller through the fuser belt. Once broken, the metal-based resistive heater no longer gives off sufficient heat to the fuser belt, resulting in defective fusing performance of the fixing device.

SUMMARY OF THE INVENTION

Exemplary aspects of the present invention are put forward in view of the above-described circumstances, and provide a novel fixing device that fixes a toner image in place on a recording medium.

In one exemplary embodiment, the novel fixing device includes an endless fuser belt, a contact member, a pressure member, a heater, a heater support, and a belt tensioner. The endless fuser belt is looped into a generally cylindrical configuration extending in an axial direction thereof for rotation in a circumferential direction thereof. The contact member extends in the axial direction inside the loop of the fuser belt. The pressure member extends in the axial direction with the belt interposed between the contact member and the pressure member. The pressure member is pressed against the contact member through the fuser belt to form a fixing nip through which a recording medium is passed under heat and pressure. The heater is disposed inside the loop of the fuser belt adjacent to an inner circumference of the fuser belt to heat the fuser belt. The heater support is disposed inside the loop of the fuser belt to hold the heater in position. The belt tensioner is disposed inside the loop of the fuser belt to tighten the belt so as to maintain the belt in contact or close proximity with the heater.

Other exemplary aspects of the present invention are put forward in view of the above-described circumstances, and provide a novel image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
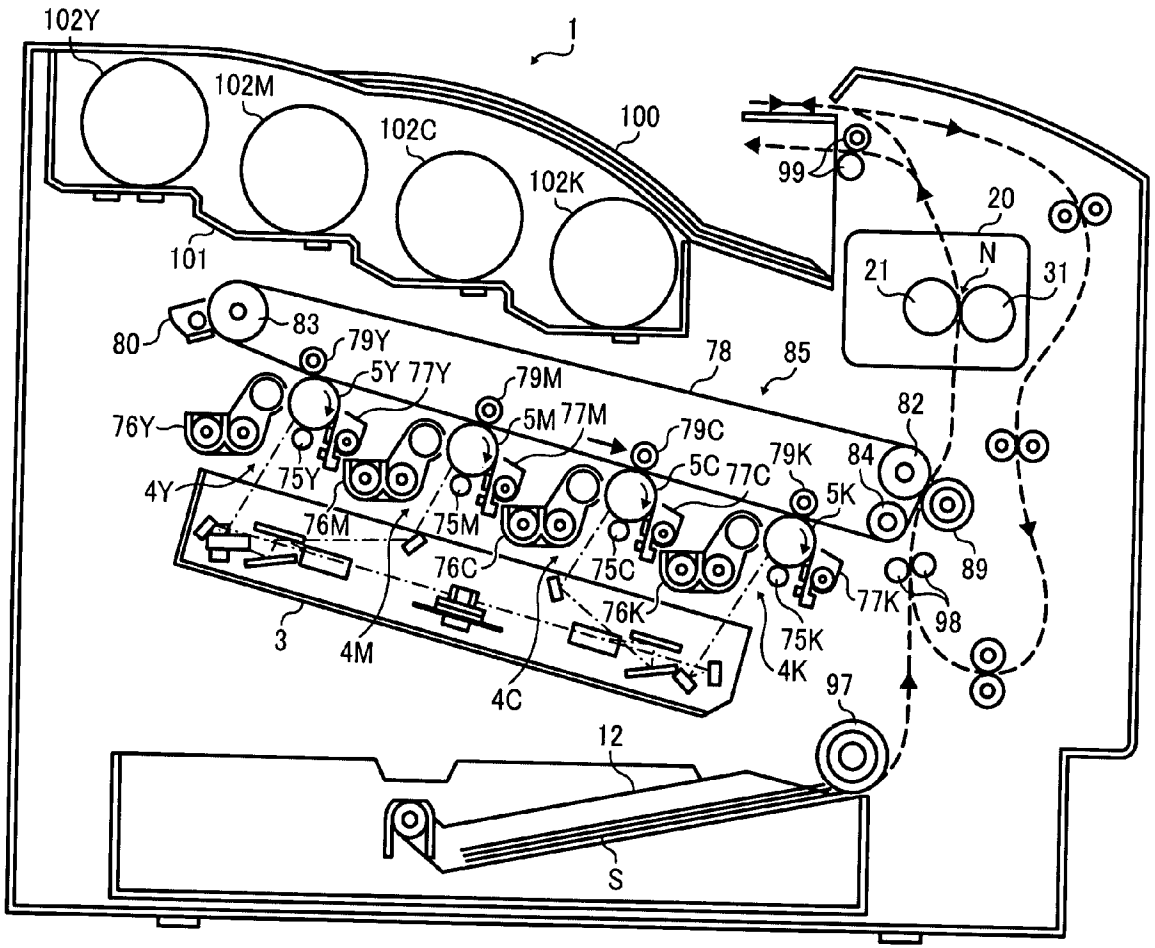
FIG. 1 schematically illustrates an image forming apparatus incorporating a fixing device according to one embodiment of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 schematically illustrates an image forming apparatus 1 incorporating a fixing device 20 according to one embodiment of this patent specification.

As shown in FIG. 1, the image forming apparatus 1 is a tandem color printer including four imaging stations 4Y, 4M, 4C, and 4K arranged in series along the length of an intermediate transfer unit 85 and adjacent to a write scanner 3, which together form an electrophotographic mechanism to form an image with toner particles on a recording medium such as a sheet of paper S, for subsequent processing through the fixing device 20 located above the intermediate transfer unit 85. The image forming apparatus 1 also includes a feed roller 97, a pair of registration rollers 98, a pair of discharge rollers 99, and other conveyor and guide members together defining a sheet conveyance path, indicated by broken lines in the drawing, along which a recording sheet S advances upward from a bottom sheet tray 12 accommodating a stack of recording sheets toward the intermediate transfer unit 85 and then through the fixing device 20 to finally reach an output tray 100 situated atop the apparatus body.

In the image forming apparatus 1, each imaging unit (indicated collectively by the reference numeral 4) has a drum-shaped photoconductor 5 surrounded by a charging device 75, a development device 76, a cleaning device 77, a discharging device, not shown, etc., which work in cooperation to form a toner image of a particular primary color, as designated by the suffixes "Y" for yellow, "M" for magenta, "C" for cyan, and "K" for black. The imaging units 4Y, 4M, 4C, and 4K are supplied with toner from replaceable toner bottles 102Y, 102M, 102C, and 102K, respectively, accommodated in a toner supply 101 in the upper portion of the apparatus 1.

The intermediate transfer unit 85 includes an intermediate transfer belt 78, four primary transfer rollers 79Y, 79M, 79C, and 79K, a secondary transfer roller 89, and a belt cleaner 80, as well as a transfer backup roller or drive roller 82, a cleaning backup roller 83, and a tension roller 84 around which the intermediate transfer belt 78 is entrained. When driven by the roller 82, the intermediate transfer belt 78 travels counterclockwise in the drawing along an endless travel path, passing through four primary transfer nips defined between the primary transfer rollers 79 and the corresponding photoconductive drums 5, as well as a secondary transfer nip defined between the transfer backup roller 82 and the secondary transfer roller 89.

The fixing device 20 includes a fuser member 21 and a pressure member 31, one being heated and the other being pressed against the heated one, to form an area of contact or a "fixing nip" N therebetween in the sheet conveyance path. A detailed description of the fixing device 20 will be given later with reference to FIG. 2 and subsequent drawings.

During operation, each imaging unit 4 rotates the photoconductor drum 5 clockwise in the drawing to forward its outer, photoconductive surface to a series of electrophotographic processes, including charging, exposure, development, transfer, and cleaning, in one rotation of the photoconductor drum 5.

First, the photoconductive surface is uniformly charged by the charging device 75 and subsequently exposed to a modulated laser beam emitted from the write scanner 3. The laser exposure selectively dissipates the charge on the photoconductive surface to form an electrostatic latent image thereon according to image data representing a particular primary color. Then, the latent image enters the development device which renders the incoming image, visible using toner. The toner image thus obtained is forwarded to the primary transfer nip between the intermediate transfer belt 78 and the primary transfer roller 79.

At the primary transfer nip, the primary transfer roller 79 applies a bias voltage of a polarity opposite that of the toner to the intermediate transfer belt 78. This electrostatically transfers the toner image from the photoconductive surface to an outer surface of the belt 78, with a certain small amount of residual toner particles left on the photoconductive surface. Such transfer process occurs sequentially at the four transfer nips along the belt travel path, so that toner images of different colors are superimposed one atop another to form a single multicolor image on the surface of the intermediate transfer belt 78.

After primary transfer, the photoconductive surface enters the cleaning device 77 to remove residual toner by scraping it off with a cleaning blade, and then to the discharging device to remove residual charges for completion of one imaging cycle. At the same time, the intermediate transfer belt 78 forwards the multicolor image to the secondary transfer nip between the transfer backup roller 82 and the secondary transfer roller 89.

Meanwhile, in the sheet conveyance path, the feed roller 97 rotates counterclockwise in the drawing to introduce a recording sheet S from the sheet tray 12 toward the pair of registration rollers 98 being rotated. Upon receiving the fed sheet S, the registration rollers 98 stop rotation to hold the incoming sheet S therebetween, and then advance it in sync with the movement of the intermediate transfer belt 78 to the secondary transfer nip. At the secondary transfer nip, the multicolor image is transferred from the belt 78 to the recording sheet S, with a certain small amount of residual toner particles left on the belt surface.

After secondary transfer, the intermediate transfer belt 78 enters the belt cleaner 80, which removes and collects residual toner from the intermediate transfer belt 78. At the same time, the recording sheet S bearing the powder toner image thereon is introduced into the fixing device 20, which fixes the multicolor image in place on the recording sheet S with heat and pressure through the fixing nip N.

Thereafter, the recording sheet S is ejected by the discharge rollers 99 to the output tray 100 for stacking outside the apparatus body, which completes one operational cycle of the image forming apparatus 1.

Figure 2:
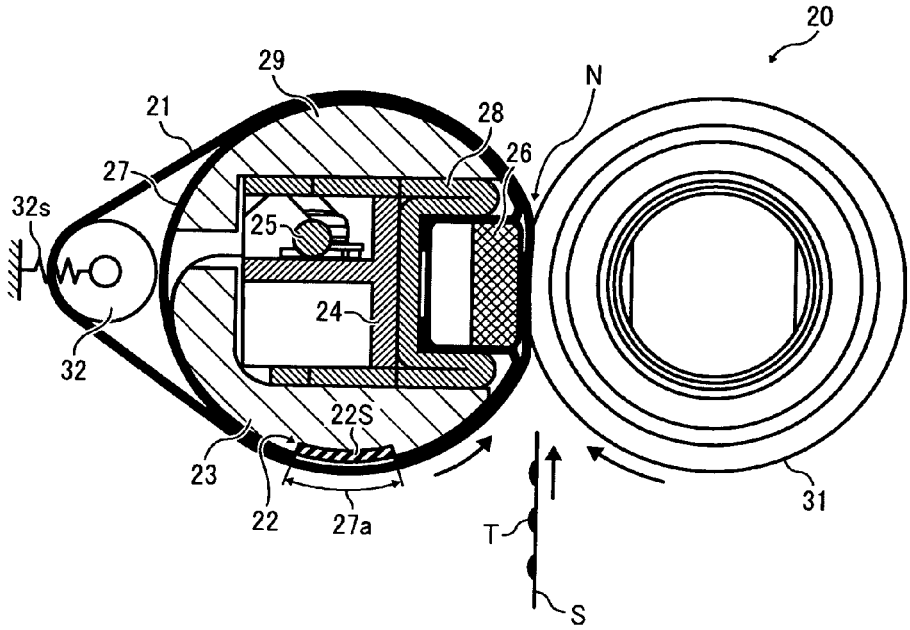
FIG. 2 is an end-on, axial cutaway view schematically illustrating the fixing device according to this patent specification.

FIG. 2 is an end-on, axial cutaway view schematically illustrating the fixing device 20 incorporated in the image forming apparatus 1 according to a first embodiment of this patent specification.

As shown in FIG. 2, the fixing device 20 includes an endless, rotatable fuser sleeve or belt 21 looped into a generally cylindrical configuration for rotation in a circumferential direction, and a rotatable pressure roller 31 being a generally cylindrical roller, as well as an elongated contact pad 26 disposed inside the loop of the fuser sleeve 21, all of which extend in an axial, longitudinal direction perpendicular to the sheet of paper on which the FIG. is drawn. The pressure roller 31 is equipped with a biasing mechanism, not shown, that presses the pressure roller 31 against the contact pad 26 via the fuser sleeve 21 to form a fixing nip N therebetween.

Figure 3A:
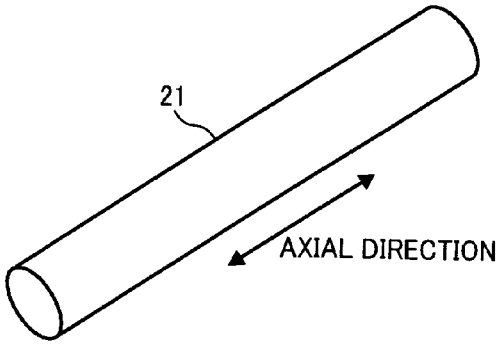
FIGS. 3A and 3B illustrate directional terms applied to the fixing device in this patent specification.
Figure 3B:
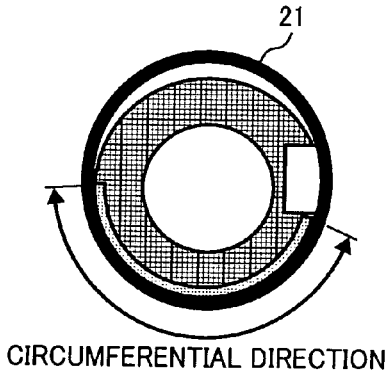

As used herein, the term "axial direction" refers to a direction parallel to a longitudinal, rotational axis around which rotates a generally cylindrical body, in particular, the fuser sleeve 21, as illustrated in FIG. 3A. The term "circumferential direction" refers to a direction along a circumference of a generally cylindrical body, in particular, that of the fuser sleeve 21, as illustrated in FIG. 3B. These directional terms apply not only to the fuser sleeve 21 itself but also to its associated structures, either in their operational position after assembly or in their original forms before or during assembly.

Further, as used herein, the term "maximum compatible width" refers to a maximum width of a recording sheet S that the fixing device 20 can accommodate through the fixing nip N. Unless specifically indicated otherwise, this term is used to describe the dimensions of recording sheet, in particular the width or length of the recording sheet along the axial direction of the fuser sleeve 21 at the fixing nip N.

With continued reference to FIG. 2, inside the loop of the fuser sleeve 21 are a tubular sleeve holder 27 that retains the fuser sleeve 21 in its generally cylindrical configuration, as well as a belt tensioner 32 disposed opposite the sleeve holder 27. According to this patent specification, the belt tensioner 32 serves to tighten the fuser sleeve 21 so as to hold an inner circumference of the sleeve 21 at least partially in contact with the tubular holder 27. Several embodiments of the belt tensioner 32 and its associated structure will be described later in more detail.

Also inside the loop of the fuser sleeve 21 is a heater 22 disposed adjacent to the inner circumference of the fuser sleeve 21 to heat the fuser sleeve 21. In the present embodiment, the heater 22 comprises a planar heat generator 22S in the form of a thin flexible sheet that stays flat when disassembled and can be bent into a desired configuration upon assembly. The heat generator 22S is held in contact or close proximity with the inner circumference of the fuser sleeve 21 via an opening or window 27*a* defined in the sleeve holder 27 to heat the fuser sleeve 21 directly by conduction.

The tubular sleeve holder 27 accommodates various pieces of fuser equipment that together constitute an internal structure of the fuser sleeve 21, each of which is positioned on a core mount formed by a combination of a first mounting stay 28 shaped in the letter "H" in axial cross-section and a second mounting stay 24 shaped in the letter "T" in axial cross-section. For example, a heater support 23 for holding the heater 22 in position and an optional, insulative support 29 for supporting the tubular holder 29 are disposed on the outside of the first mounting stay 28 opposite to each other, each defining a curved surface along the inner circumference of the sleeve holder 27. Wiring 25 extends along the second mounting stay 24 to supply the heater 22 with electricity from an external or internal power source, not shown.

During operation, upon initiation of image formation processes in response to a print request input by a user manipulating an operating panel or transmitted via a computer network, the biasing mechanism causes the pressure roller 31 to press against the contact pad 26 through the fuser sleeve 21. With a fixing nip N thus established, a rotary drive motor activates the pressure roller 31 to rotate clockwise in the drawing, which in turn rotates the fuser sleeve 21 counterclockwise in the drawing.

The fuser sleeve 21 rotates in sliding contact with the sleeve holder 27 at least around the opening 27*a* through which the heat generator 22 is exposed to the inner circumference of the fuser sleeve 21. With the belt tensioner 32 according to this patent specification, proper tension imparted to the fuser sleeve 21 maintains the inner surface of the sleeve 21 in contact or close proximity with the heat generator 22S with a uniform, consistent spacing therebetweeen.

Meanwhile, the power source starts supplying electricity to the heater 22 via the wiring 25. The heater 22, having its heating element 22S thus electrified, generates heat for immediate and efficient conduction to the fuser sleeve 21 held in direct contact therewith. Initiation of the heater power supply may be simultaneous with activation of the rotary drive motor. Alternatively, the two events precede or follow each other with an appropriate interval of time depending on specific configuration.

Power supply to the heater 22 is adjusted according to readings of a thermometer disposed either in contact with or spaced apart from the fuser sleeve 21, which heats the fixing nip N to a given processing temperature and maintains sufficient heat for processing an incoming print job.

Thereafter, a recording sheet S bearing an unfixed, powder toner image T enters the fixing device 20 with its front, printed face brought into contact with the fuser sleeve 21 and bottom face with the pressure roller 31. The recording sheet S moves along the rotating surfaces of the fuser sleeve 21 and the pressure roller 31 through the fixing nip N, where the fuser sleeve 21 heats the incoming sheet S to fuse and melt the toner particles, while the pressure roller 31 presses the sheet S against the contact pad 26 to cause the molten toner to settle onto the sheet surface. As the toner image T is thus fixed in place through the fixing nip N, the recording sheet S is forwarded to exit the fixing device 20.

After exit of the recording sheet S, the drive motor stops rotation of the pressure roller 31 and the fuser sleeve 21 where there is no subsequent print request. At the same time, the power supply to the heater 22 turns off where the fixing device operates in a normal or sleep mode to conserve power. Contrarily, where the fixing device is in a standby mode, the power supply to the heater 22 may continue to keep the fuser sleeve 21 at a certain moderate temperature so as to immediately return to operation upon receiving a future print request.

In the present embodiment, the fuser sleeve 21 comprises a flexible, endless belt looped into a generally cylindrical configuration having a length dimensioned according to a width of recording sheet S accommodated through the fixing nip N. For example, the fuser sleeve 21 may be a multilayered endless belt having an outer diameter of approximately 30 mm in its looped, generally cylindrical configuration, consisting of a substrate of metal approximately 30 μm to approximately 50

μm thick, covered at least by an outer layer of release agent approximately 50 μm thick deposited thereupon.

The substrate of the fuser sleeve 21 may be formed of a thermally conductive metal, such as iron, cobalt, nickel, or an alloy of such metals. The release layer of the fuser sleeve 21 may be formed of a fluorine compound such as perfluoroalkoxy (PFA) formed into a 50-μm thick tubular configuration, which allows good release of toner where the fuser sleeve 21 comes into contact with the toner image T on the recording sheet S.

The pressure roller 31 comprises a cylindrical roller formed of a hollowed core of metal, such as aluminum or copper, covered with an intermediate layer of elastic, thermally insulating material, such as silicone rubber or other solid rubber, approximately 2 mm to approximately 3 mm thick, and an outer layer of release agent, such as a PFA layer formed into a tubular configuration, approximately 50 μm thick, deposited one upon another. The pressure roller 31 is equipped with a drive motor that imparts rotation to the roller 31 upon activation. Optionally, the pressure roller 31 may have a dedicated heater, such as a halogen heater, accommodated inside the hollow of the metal core.

The contact pad 26 comprises an elongated elastic member extending in the axial direction, having at least its front side (i.e., the side facing the pressure roller 31 via the fuser sleeve 21) formed of thermally insulating, elastic material such as fluorine rubber. The elastic front face of the contact pad 26 conforms to the circumference of the pressure roller 31 pressed against the contact pad 26, so that the fuser sleeve 21 defines a concave configuration curving inward to the contact pad 26 along which a recording sheet S moves through the fixing nip N. For good slidability and wear resistance, this front face is preferably formed of low-frictional, anti-abrasive material, such as a sheet of polytetrafluoroethylene (PTFE), commercially available under the trademark Teflon®.

The first mounting stay 28 comprises an elongated piece of rigid material extending across the axial length of the fuser sleeve 21, such as a bent sheet of metal obtained through metalworking processes, consisting of a pair of opposed, parallel side walls and a central wall perpendicular to the side walls, positioned generally centrally within the cylindrical sleeve 21.

The first mounting stay 28 accommodates and supports the contact pad 26 facing the pressure roller 31 between its parallel side walls, with the front face of the contact pad 26 protruding toward the pressure roller 31 slightly beyond the edges of the stay 28. Such positioning protects the contact pad 26 from substantial deformation under nip pressure from the pressure roller 31, while maintaining the stay 28 away from contact with the fuser sleeve 21.

The first mounting stay 28 also supports the heater support 23 attached to outside of its side wall, facing approximately half the inner circumference of the fuser sleeve 21 upstream of the fixing nip N. Mounting the heater support 23 may be accomplished either by adhesive bonding to the stay 28 for ease of assembly, or by some other connecting mechanism without adhesion to the stay 28 for eliminating undesirable heat conduction from the heater support 23 to the stay 28.

The second mounting stay 24 comprises an elongated piece of material extending across the axial length of the fuser sleeve 21, consisting of a pair of flanges perpendicular to each other, one fitted between the two side walls of the stay 28, and the other extending parallel to the side walls of the stay 28, along which the wiring 25 lies electrically connecting the heater 22.

The heater support 23 comprises a rigid, partially cylindrical piece of heat-resistant, thermally insulating material. When mounted in position, the heater support 23 has its curved surface extending along a given section of the inner circumference of the tubular sleeve holder 27 holding the fuser sleeve 21 in its generally cylindrical configuration, so that the heater 22 supported thereon lies in contact or close proximity with the fuser sleeve 21.

The heater support 23 may be of any thermal insulator that exhibits high heat resistance to resist heat generated by the heater 22, high mechanical strength to support the heater 22 without deformation upon contacting the rotating fuser sleeve 21, and good insulation performance to thermally isolate the stay 28 from the heater 22 for promoting heat transfer from the heater 22 to the fuser sleeve 21. For example, the heater support 23 may be configured as a molded piece of polyimide resin foam to obtain sufficient strength and immunity against deformation, particularly where the heater 22 operates in continuous contact with the rotating surface of the fuser sleeve 21 and therefore is subjected to strain toward the fixing nip N. For further reinforcement, the heater support 23 may be optionally equipped with an internal reinforcement formed of solid resin.

Figure 4:
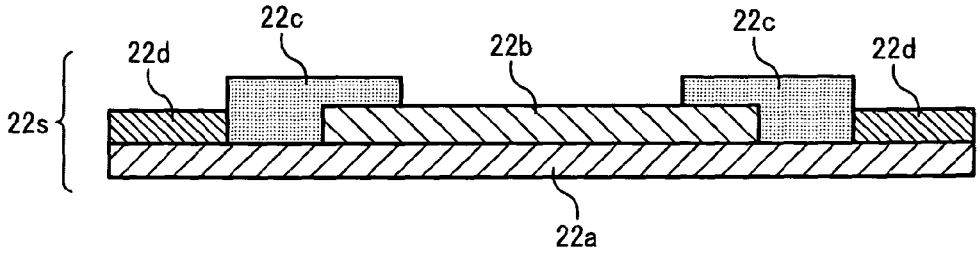
FIG. 4 is a cross-sectional view schematically illustrating a configuration of a planar heat generator employed in the fixing device of FIG. 2.

As mentioned earlier, the heater 22 in the present embodiment comprises a planar heat generator 22S in the form of a thin flexible sheet. With reference to FIG. 4, which is a cross-sectional view schematically illustrating a configuration of the planar heat generator 22S, the heat generator 22S is shown consisting of a substrate 22*a* of an electrically insulative material, on which are deposited a resistive heating layer 22*b* of heat-resistant material and an electrode layer 22*c* of conductive material adjoining each other to form heating circuitry, as well as an insulation layer 22*d* of an electrically insulative material for isolating the heating circuitry from adjacent electrode layers and other electrical components. The heat generator 22S also has a set of electrode terminals 22*e* at opposed longitudinal ends to conduct electricity from the wiring 25 to the heating circuitry, which is presented later in FIG. 5 and subsequent drawings.

Specifically, the substrate 22*a* is a thin, elastic film of heat-resistant resin such as polyethylene terephthalate (PET), and preferably, polyimide resin for obtaining sufficient heat-resistance, electrical insulation, and flexibility.

The resistive heating layer 22*b* is a thin, conductive layer of composite material that exhibits a certain resistivity so as to generate Joule heat when supplied with electricity. For example, the resistive heating layer 22*b* may be a thin, conductive film of a heat-resistant resin such as polyimide containing uniformly dispersed particles of conductive material, such as carbon or metal, obtained by coating the substrate 22*a* with a precursor of heat-resistant resin mixed with a dispersion of conductive material. Alternatively, instead, the resistive heating layer 22*b* may be a laminated layer of heat-resistant material and conductive material, obtained by coating the substrate 22*a* initially with a conductive layer and then with a metal layer deposited thereon.

Conductive materials suitable for use in the resistive heating layer 22*b* include carbon, either in the form of carbon black particles or in the form of nano- or micro-particles consisting at least one of carbon nano-fiber, carbon nanotube, and carbon micro-coil, as well as metal, such as silver, aluminum, or nickel, in the form of particles or filaments.

The electrode layer 22*c* may be obtained by depositing a paste of conductive material, such as conductive ink or silver, or by attaching a foil or mesh of metal to the surface of the substrate 22*a*. The insulating layer 22*d* may be obtained by depositing the same insulating material used to form the substrate 22*a*, such as polyimide resin.

The planar heat generator 22S is obtained by depositing different materials one upon each other on the substrate 22*a*. That is, the substrate 22*a* is subjected initially to a deposition of resistive material to form the resistive heating layer 22*b*, then to a deposition of heat-resistant, insulating resin to form the insulation layer 22*d*, and finally to a deposition of conductive paste to form the electrode layer 22*c*, with each material being deposited through a patterned mask which exposes only a portion of the substrate or previously deposited film to form the resulting layer in a desired configuration.

The heat generator 22S as a whole is a substantially smooth, thin flexible sheet approximately 0.1 mm to approximately 1 mm thick that exhibits a certain flexibility so as to conform to the curved surface of the heater support 23 when assembled. The heat generator 22S is dimensioned depending on specific configurations of the fuser sleeve 21, for example, approximately 20 cm in the axial direction and approximately 2 cm in the circumferential direction.

It should be noted that although the embodiment depicted in FIG. 2 shows the planar heat generator 22S positioned approximately 90° displaced from the fixing nip N along the circumferential direction, the heat generator 22S may be provided at any position from opposite the fixing nip N toward entry of the fixing nip N along the circumferential direction, and the position, shape, and dimensions of the heat generator may be otherwise than as specifically depicted herein.

In such a configuration, the planar heat generator 22S exhibits a relatively low heat capacity and therefore can rapidly produce a desired amount of heat upon activation, which can be adjusted by varying volume resistivity of the resistive heating layer 22*b*, or more precisely, by varying the type, shape, size, and dispersion of conductive particles used in the resistive heating layer 22*b*. For example, a rectangular heat generator approximately 20 cm wide and approximately 2 cm long formed of a material that produces approximately 35 watts per square centimeter ($W/cm^2$) yields a total of approximately 1,200 W output when electrified.

The resin-based heat generator 22S is highly durable compared to other types of heat generator, such as those formed of filaments of stainless steel or other metal. One reason is that the resin-based flexible sheet can withstand repeated flexion or stress caused by rotational vibration transmitted as the pressure roller 31 rotates during operation. Another reason is that the substantially smooth surface of the resin-based sheet is resistant to wear when sliding against the rotating fuser sleeve 21, compared to a rough, irregular surface formed of metal filaments which is susceptible to abrasion when operated in sliding contact with the inner circumference of the fuser sleeve 21. Further resistance against sliding wear can be obtained by providing an outer coating of lubricant such as fluorine resin over the resistive heating layer 22*b*.

Preferably, the planar heat generator 22S may have multiple heating elements operated independent of each other to heat different portions of the fuser sleeve 21 along the axial direction, which enables the fixing device 20 to properly heat different sizes of recording sheet S without overheat or undue consumption of energy. Such arrangement of the planar heat generator 22S is described below with reference to FIGS. 5 through 8.

Figure 5:
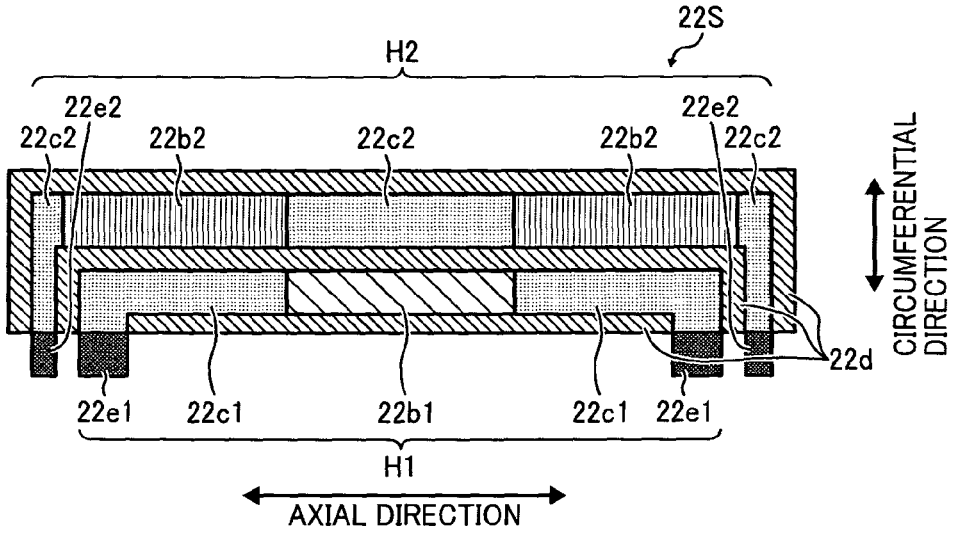
FIG. 5 is a plan view schematically illustrating one embodiment of the planar heat generator of FIG. 4 before assembly.

As shown in FIG. 5, which is a plan view schematically illustrating one embodiment of the planar heat generator 22S in its original, disassembled form before assembly, the planar heat generator 22S has its entire operational area primarily divided along the axial direction into two primary sections electrically insulated from each other by the insulating layer 22*d* forming insulating regions, with each primary section being further divided along the circumferential direction to form a total of six subsections, within which the resistive heating layer 22*b* and the electrode layer 22*c* are deposited to form a resistive region and a conductive region, respectively.

Table 1 below shows the six subsections of the planar heat generator 22S as entries of a 2-by-3 matrix, positioned relative to those of the fuser sleeve 21, in which the row represents position along the circumferential direction, with "1" denoting a first side farther from the fixing nip N and "2" denoting a second side closer to the fixing nip N, and the column represents position along the axial direction, with "1" and "3" denoting a pair of axial ends opposed to each other, and "2" denoting an axial center between the opposed axial ends.

TABLE 1

| Subsections of the planar heat generator | | | | |
|---|---|---|---|---|
| | | Axial | | |
| | | First end | Center | Second end |
| Circumferential | Second side | (2, 1) | (2, 2) | (2, 3) |
| | First side | (1, 1) | (1, 2) | (1, 3) |

Specifically, the planar heat generator 22S includes a pair of first and second heating circuits H1 and H2, each extending across three sub-sections along the axial direction on one circumferential side. The heating circuits H1 and H2 operate independently of each other with the insulation regions 22*d* provided between and around the heating circuits H1 and H2 to prevent short-circuiting across the heat generator 22S.

More specifically, the first heating circuit H1 consists of a first resistive region 22*b*1 formed in the subsection (1, 2) and first conductive regions 22*c*1 formed in the subsections (1, 1) and (1, 3) on the opposed sides of the subsection (1, 2), with a first pair of electrode terminals 22*e*1 connected to the opposed conductive regions 22*c*1. The second heating circuit H2 consists of second resistive regions 22*b*2 formed in the subsections (2, 1) and (2, 3) and second conductive regions 22*c*2 formed in the subsection (2, 2) as well as in the subsections (2, 1) and (2, 3), with a second pair of electrode terminals 22*e*2 connected to the opposed conductive regions 22*c*2.

In such a configuration, the heat generator 22S can selectively heat the subsection (1, 2) corresponding to the axial center of the fuser sleeve 21 by activating the first heating circuit H1 with power supplied across the first pair of electrode terminals 22*e*1, which causes the resistive region 22*b*1 to generate Joule heat, leaving the conductive regions 22*c* therearound substantially unheated.

By contrast, the heat generator 22S can selectively heat the subsections (2, 1) and (2, 2) corresponding to the opposed axial ends of the fuser sleeve 21 by activating the second heating circuit H2 with power supplied across the second pair of electrode terminals 22*e*2, which causes the resistive regions 22*b*2 to generate Joule heat upon activation, leaving the conductive regions 22*c*2 therearound substantially unheated.

Thus, the planar heat generator 22S can selectively heat intended portions of the fuser sleeve 21 by activating corresponding one(s) of the multiple heating elements H1 and H2 that operate independently of each other. Such selective heating capability of the heat generator 22S enables the fixing device 20 to efficiently accommodate different sizes of recording sheet S for thermal processing through the fixing nip N.

For example, to process a small-sized, narrow recording sheet through the fixing nip N, the fixing device 20 activates solely the first heating circuit H1 by energizing the first electrode terminals 22*e*1, or alternatively, both the first and second heating circuits H1 and H2 by energizing the first electrode terminals 22*e*1 and 22*e*2, the former with greater power supply than the latter. The first heating circuit H1 thus activated selectively heats the axial center of the fuser sleeve 21 where fixing process takes place upon entry of the narrow recording sheet.

By contrast, to process a large-sized, wide recording sheet through the fixing nip N, the fixing device 20 activates both the first and second heating circuits H1 and H2 by energizing the first electrode terminals 22*e*1 and 22*e*2. The first and second heating circuits H1 and H2 thus activated heat the entire length of the fuser sleeve 21 where fixing process takes place upon entry of the wide recording sheet.

Heating the fuser sleeve 21 by activating either or both of the multiple heating elements H1 and H2 depending on the size of recording sheet S in use results in reduced power consumed by the fixing device 20. In particular, selectively using the first heating element H1 in processing small-sized sheets in succession prevents excessive heating of non-operating portions of the fuser sleeve 21, which would otherwise trigger shutdown for protection against machinery damage, resulting in reduced yields of the fixing device.

Selective heating capability provided by the single, integral heat generator 22S is superior to that provided by separate heating elements formed of different materials, as the multiple heating elements H1 and H2, formed of the same material through the same process during manufacture, exhibit similar thermal properties to ensure the heat generator 22S heats the fuser sleeve 21 uniformly along the axial direction as well as along the circumferential direction.

In the embodiment depicted in FIG. 5, the two resistive regions 22*b*1 and 22*b*2 in the different heating circuits H1 and H2 are completely offset from each other in the axial direction. Alternatively, instead, the planar heat generator 22S may be arranged to have the resistive regions 22*b*1 and 22*b*2 only partially offset, that is, contiguous with and/or adjacent to each other through the insulation region 22*d*.

Figure 6:
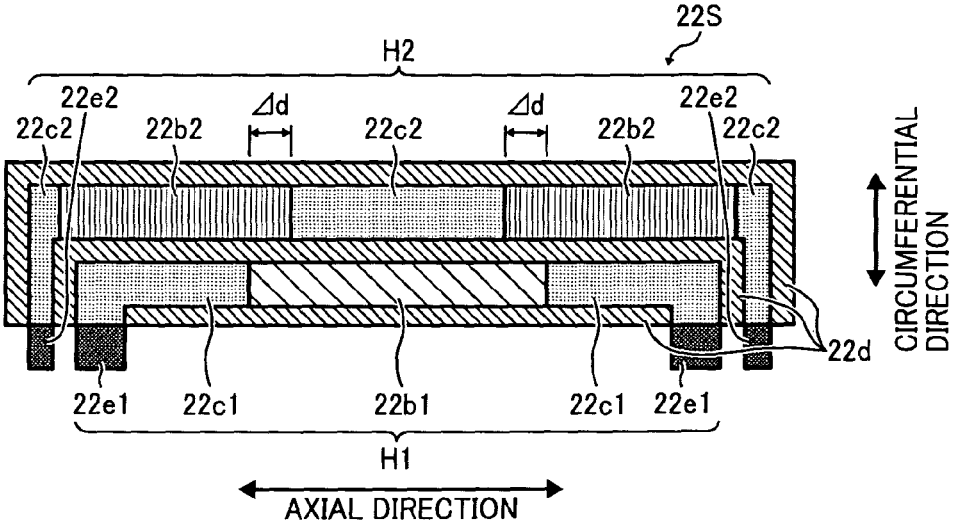
FIG. 6 is a plan view schematically showing one arrangement of the planar heat generator of FIG. 4.

For example, as shown in FIG. 6, the heat generator 22S may have the first and second resistive regions 22*b*1 and 22*b*2 formed in substantially rectangular shapes contiguous with each other through the insulation region 22*d* therebetween, so that when energized, the first and second heating circuits H1 and H2 heat one or more common areas of the fuser sleeve 21 each of which has a length Δd in the axial direction.

Such arrangement is effective where heat generated by the resistive regions 22*b* dissipates into the insulating regions 22*d* and the conductive regions 22*c* which are thermally conductive, so that the resistive regions 22*b* tend to provide higher amounts of heat at their center than at their side edges for transfer to the fuser sleeve 21. With the two resistive regions 22*b*1 and 22*b*2 completely offset and non-contiguous with each other, such tendency results in unstable heat across the fuser sleeve 21 causing imperfections in printed images, in which those portions corresponding to the adjoining edges of the resistive regions 22*b* remain cooler than other, adjacent portions of the fuser sleeve 21.

By contrast, in the arrangement of FIG. 6, the contiguous resistive regions 22*b*1 and 22*b*2 can heat the fuser sleeve 21 in conjunction with each other at their adjoining edges where the amount of heat yielded by each heating element is relatively low, resulting in uniform heat across the fuser sleeve 21, which leads to higher imaging quality of the fixing device 20.

Figure 7:
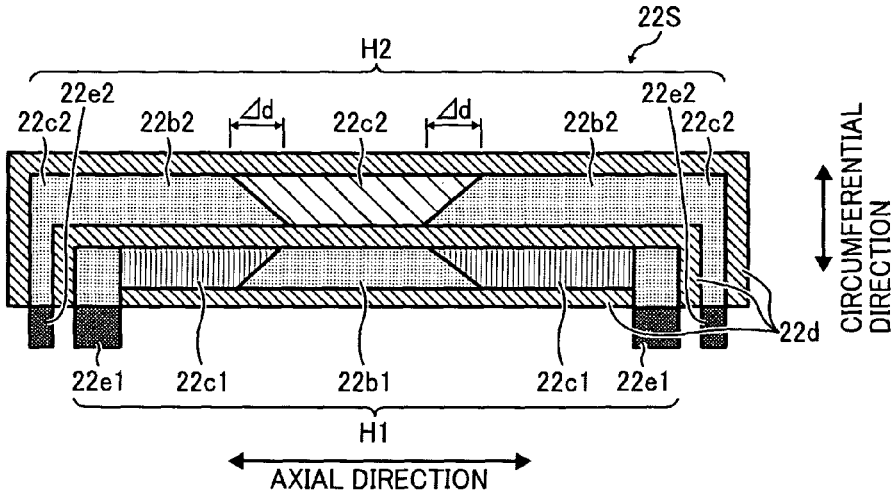
FIG. 7 is a plan view schematically showing another arrangement of the planar heat generator of FIG. 4.

Further, as shown in FIG. 7, the heat generator 22S may have the resistive regions 22*b*1 and 22*b*2 formed in tapered rectangular shapes, instead of square rectangular shapes, adjacent to each other, so that when energized, the first and second heating circuits H1 and H2 heat one or more common areas of the fuser sleeve 21 each of which has a length Δd in the axial direction.

As in the embodiment depicted in FIG. 6, the contiguous resistive regions 22*b*1 and 22*b*2 can heat the fuser sleeve 21 in conjunction with each other at their adjoining edges where the amount of heat yielded by each heating element is relatively low, resulting in uniform heat across the fuser sleeve 21, which leads to higher imaging quality of the fixing device 20.

Moreover, in the arrangement of FIG. 7, the resistive regions 22*b*1 and 22*b*2 have their depths or dimensions along the circumferential direction varying along the axial direction, so that the ratio of their depths varies constantly along the axial direction. Compared to a configuration in which the ratio of the depths of the resistive regions 22*b*1 and 22*b*2 is fixed, varying the depths of the resistive regions 22*b*1 and 22*b*2 allows for adjusting heat distribution across the fuser sleeve 21 and cancelling out undesired process variations of the heat generator 22S, in particular, those in the axial dimension Δd, which would otherwise result in unstable heat across the fuser sleeve 21.

As mentioned, the planar heat generator 22S is obtained by depositing different materials one upon each other on the substrate 22*a*, each through a patterned mask which exposes only a portion of the substrate or previously deposited film to form the resulting layer in a desired configuration. Thus, using suitable deposition techniques, the planar heat generator 22S may be arranged to have different configurations of resistive and conductive regions by adjusting the shapes of masks used in successive deposition processes.

Figure 8:
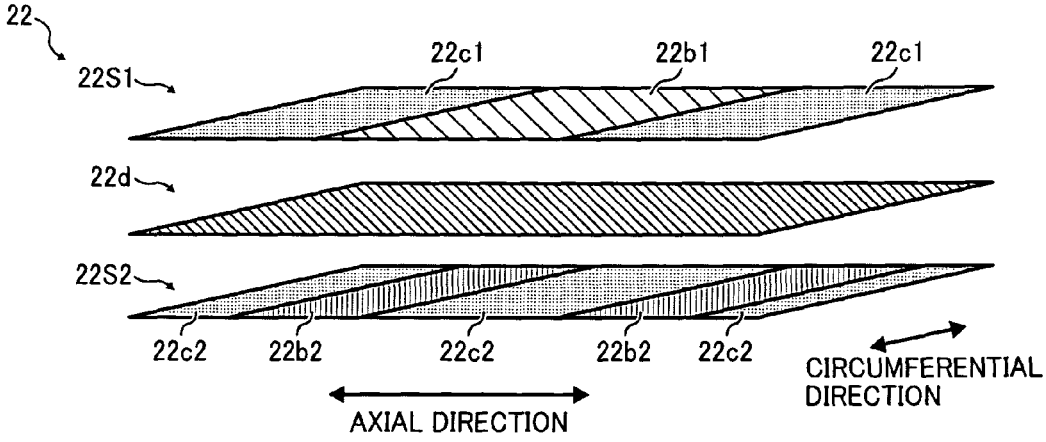
FIG. 8 is an exploded, perspective view showing a further embodiment of the planar heat generator.

In a further embodiment, the planar heat generator 22S may have a multilayered or laminated structure obtained by combining multiple layers each forming a single heating circuit. FIG. 8 is an exploded, perspective view showing such embodiment of the planar heat generator 22S.

As shown in FIG. 8, the planar heat generator 22S includes a pair of first and second layers 22*s*1 and 22*s*2 superimposed one atop another, with an insulation layer 22*d* interposed therebetween.

Specifically, the first layer 22*s*1 has its operational area generally divided into three sections along the axial direction to form a first heating circuit H1, consisting of a first resistive region 22*b*1 formed in the central section, and first conductive regions 22*c*1 formed in the sections on the opposed sides of the operational area.

The second layer 22*s*2 has its operational area divided into five sections along the axial direction to form a second heating circuit H2, consisting of second resistive regions 22*b*2 formed in two sections on the opposed sides of the central section, and second conductive regions 22*c*2 formed in the central section and the remaining two sections at the opposed ends of the operational area.

The heating circuits H1 and H2 operate independently of each other with the insulation layer 22*d* provided between the heating circuits H1 and H2 to prevent short-circuiting across the heat generator 22S.

In such a configuration, the planar heat generator 22S can selectively heat its central section corresponding to the axial center of the fuser sleeve 21 by activating the first heating circuit H1 with power supplied to cause the resistive region 22*b*1 to generate Joule heat, leaving the conductive regions 22*c*1 therearound substantially unheated.

By contrast, the planar heat generator 22S can selectively heat its sub-central sections corresponding to the opposed axial ends of the fuser sleeve 21 by activating the second heating circuit H2 with power supplied to cause the resistive regions 22*b*2 to generate Joule heat, leaving the conductive regions 22*c*2 therearound substantially unheated.

Thus, as in the embodiments depicted through FIGS. 5 through 7, the laminated planar heat generator 22S can selectively heat intended portions of the fuser sleeve 21 by activating corresponding one(s) of the multiple heating elements H1 and H2 that operate independently of each other.

Moreover, the laminated planar heat generator 22S composed of multiple layers each having its operational area divided only along the circumferential direction provides high heat output with compact size, compared to a configuration where the operational area of the heat generator is divided along both the axial and circumferential directions, which would require a large operational area to generate sufficient heat for high-output application, resulting in too large an overall size of the planar heater to fit into a relatively small fuser sleeve.

Referring back to FIG. 2, the tubular sleeve holder 27 is shown disposed inside the fuser sleeve 21 to support the sleeve 21 rotating therearound, optionally equipped with the thermally insulative, internal support 29 held on the first mounting stay 28 to support the tubular sleeve holder 27 from inside, downstream of the fixing nip N.

In the fixing device 20, the tubular sleeve holder 27 comprises a generally cylindrical pipe that has an outer diameter approximately 0.5 mm to approximately 1 mm smaller than the inner diameter of the fuser sleeve 21, for example, formed of a thin sheet of metal, such as iron or stainless steel, approximately 0.1 mm to approximately 1 mm in thickness.

The tubular sleeve holder 27 has a longitudinal slot at one side thereof, defined by opposed edges bent inward away from the cylindrical circumference, which accommodates the contact pad 26 so that the tubular sleeve holder 27 itself does not contact the fuser sleeve 21 or the pressure roller 31 forming the fixing nip N therebetween. The opposed edges of the longitudinal side slot are clamped together by the first mounting stay 28, which holds the sleeve holder 27 in its tubular configuration.

Upon installation, the sleeve holder 27 has its outer surface in contact with the inner surface of the fuser sleeve 21 at least from opposite the fixing nip N to immediately upstream of the fixing nip N. The sleeve holder 27 is held in position with its opposed longitudinal edges secured to opposite sidewalls or a frame of the fixing device 20.

Preferably, the tubular sleeve holder 27 is provided with a lubricant, such as silicone oil or fluorine grease, deposited on its outer surface facing the inner surface of the fuser sleeve 21. Such provision of lubricant may reduce frictional resistance at the interface where the fuser sleeve 21 rotates in sliding contact with the tubular sleeve holder 27.

The insulative support 29 comprises a rigid piece of heat-resistant, thermally insulating material, with its one side defining a curved surface along which the tubular sleeve holder 27 is held in contact or close proximity with the inner circumference of the fuser sleeve 21. Provision of such insulative support 29 is optional and may be omitted depending on the specific configuration.

The insulative support 29 may be of any thermal insulator that exhibits high heat resistance to resist heat emanating from the fuser sleeve 21 through the tubular sleeve holder 27, high mechanical strength to support the tubular sleeve holder 27 without deformation upon contacting the rotating fuser sleeve 21, and good insulation performance to prevent heat from flowing to the interior of the tubular support 27 retaining heat for conduction to the fuser sleeve 21. For example, the insulative support 29 is configured as a molded piece of polyimide resin foam, as is the case with the heater support 23 described earlier.

In such a configuration, the tubular belt holder 27 serves to ensure the fuser sleeve 21 properly rotates even at high rotational speeds, while equalizing heat distribution across the fuser sleeve 21 by conducting heat from the heater 22 for transfer to the fuser sleeve 21.

Specifically, the fuser sleeve 21 during rotation is subjected to different tensions as it passes from upstream to downstream of the fixing nip N. Upstream of the fixing nip N, the fuser sleeve 21 is relatively tight as it is drawn by the pressure roller 31 toward the fixing nip N, with its inner circumference sliding over the heater 22 while pressing against the heater support 23. Conversely, downstream of the fixing nip N, the fuser sleeve 21 is relatively loose as it is relieved of tension from the pressure roller 31. If not corrected, such looseness may adversely affect rotation of the fuser sleeve 21 downstream of the fixing nip N, which can be intolerable where the fuser sleeve 21 rotates at higher rotating speeds for high-speed application.

Provision of the tubular sleeve holder 27 holds the fuser sleeve 21 in its generally cylindrical configuration during rotation, which enables the fuser sleeve 21 to remain taut downstream of the fixing nip N where it might otherwise go slack, thereby leading to more stable operation of the fixing device. Moreover, the rigid, metal holder 27 not only provides mechanical stability during operation, but also facilitates handling of the flexible fuser sleeve 21 held therearound, leading to ready assembly of the fixing device during manufacture.

Figure 9A:
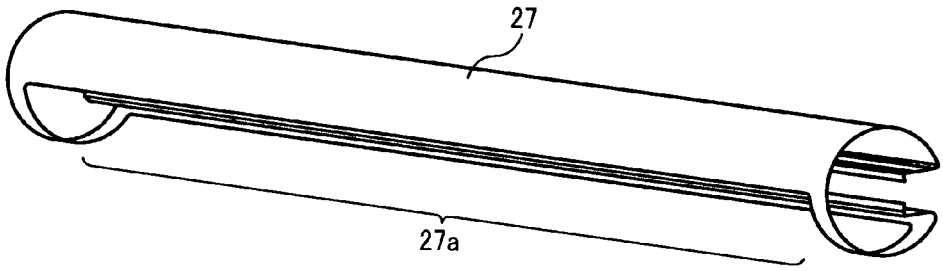
FIG. 9A is a perspective view schematically illustrating a configuration of a tubular sleeve holder before assembly, employed in the fixing device of FIG. 2.
Figure 9B:
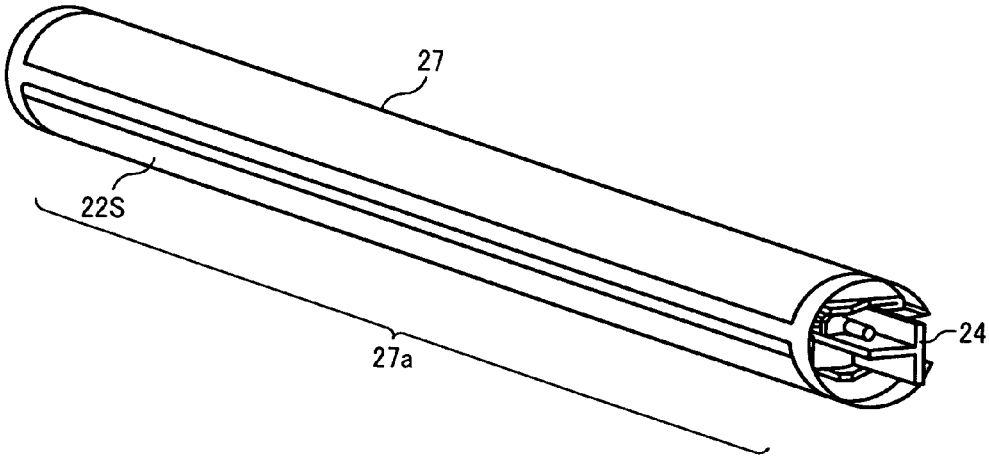
FIG. 9B is a perspective view schematically illustrating the tubular sleeve holder of FIG. 9A during assembly.

FIGS. 9A and 9B are perspective views schematically illustrating a configuration of the tubular sleeve holder 27 before and during, respectively, assembly with the planar heat generator 22S and its associated structure.

As shown in FIG. 9A, the tubular sleeve holder 27 has the elongated window or opening 27*a* formed by removing a particular portion of the circumference extending in the axial direction, which faces the heat generator 22S upon installation of the fuser assembly. As shown in FIG. 9B, the tubular sleeve holder 27 is assembled with the internal structure of the fuser assembly so that the entire operational area of the heat generator 22S is exposed through the opening 27*a*.

Figure 10:
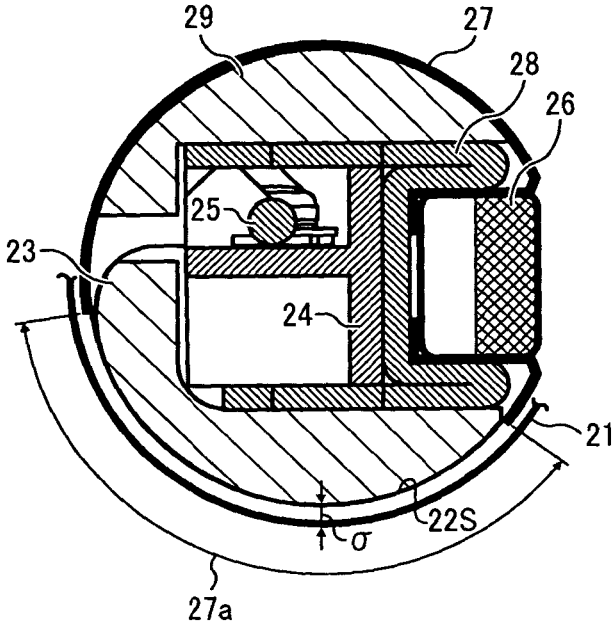
FIG. 10 is an end-on, axial cutaway view schematically illustrating the tubular sleeve holder of FIGS. 9A and 9B upon installation.

With additional reference to FIG. 10, which is an end-on, axial cutaway view schematically illustrating the tubular sleeve holder 27 with the opening 27*a* in the complete fuser assembly, the planar heat generator 22S is shown exposed through the opening 27*a* of the tubular sleeve holder 27, at a distance or spacing δ to the inner surface of the fuser sleeve 21. Considering that the fuser sleeve 21 tightens around the tubular sleeve holder 27 during operation, the spacing δ may fall in the range greater than zero and equal to or smaller than the thickness of the tubular sleeve holder 27 (e.g., not exceeding 1 mm). Provision of the opening 27*a* thus allows for positioning the fuser sleeve 21 in close proximity with the heat generator 22S, which promotes efficient heat transfer from the heat generator 22S to the fuser sleeve 21, leading to high thermal efficiency in heating the fuser sleeve 21 equipped with the tubular sleeve holder 27.

It should be noted that although the embodiment depicted in FIG. 10 shows the planar heat generator 22S retracted slightly inward from the outer circumference of the sleeve holder 27 to maintain adequate spacing δ between the heater and sleeve surfaces, alternatively, instead, the planar heat generator 22S may have its outer, operational surface extending along, or slightly beyond, the circumferential plane of the tubular sleeve holder 27. Such arrangement allows the planar heat generator 22S, held on the curved surface of the heater support 23, to establish direct contact with the inner surface of the fuser sleeve 21, resulting in increased thermal efficiency in heating the fuser sleeve 21 equipped with the tubular sleeve holder 27.

To construct the internal structure of the fuser sleeve 21 as shown in FIG. 10, the planar heat generator 22S is initially bonded to the curved surface of the heater support 23, with all its electrode terminals 22*e* arranged in the axial direction beyond the edge of the curved surface. Preferably, bonding the heat generator 22S is performed using an adhesive that exhibits low thermal conductivity, to prevent heat from dissipating to the heater support 23 during operation.

After bonding to the heater support 23, the planar heat generator 22S is bent along the longitudinal edge of the heater support 23 with the electrode terminals 22*e* directed along the flange of the second mounting stay 24 (i.e., radially inward when disposed inside the fuser sleeve 21), followed by fastening the terminals 22*e* to the flange of the second mounting stay 24, for example, using screws inserted through screw-holes provided on the stay flange and the heater terminals.

The mounting stay 24, the heater support 23, and the planar heat generator 22S thus combined are further combined with the first mounting stay 28, wherein the heater support 23 is positioned with its rear side (i.e., the side opposite the curved surface on which the heat generator 22S is supported) fitting along the outside of the mounting stay 28, followed by inserting the second mounting stay 24 between the opposed sidewalls of the first mounting stay 28 opposite to the side where the contact pad 26 is installed. The combined structure thus obtained is placed together into the tubular sleeve holder 27 to form an integrated, internal structure, which is subsequently inserted into the interior hollow of the fuser sleeve 21 to complete the fuser assembly for installation in the fixing device 20 as shown in FIG. 2.

Note that, in the fuser assembly, the planar heat generator 22S is fastened to the second mounting stay 24 at one longitudinal edge farthest from the fixing nip N along the circumferential direction. Where the heat generator 22S is not adhesively bonded to the heater support 23, fixing the longitudinal edge of the heat generator 22S causes the fuser sleeve 21 to pull the unfixed, opposite edge of the heat generator 22S toward the fixing nip N as it rotates in the circumferential direction. This in turn causes the heat generator 22S to establish stable contact with the inner circumference of the fuser sleeve 21, which allows for efficient heat transfer form the heat generator 22S to the fuser sleeve 21.

Preferably, the planar heat generator 22S is fastened to the heater support 23 using suitable adhesive material, such as glue or tape, so as to prevents the heat generator 22S from displacement and concomitant failures of the fuser assembly. In a configuration in which the heat generator has no secure connection with the heater support, the heat generator lifts off the heater support, and therefore is readily displaced as the fuser sleeve 21 rotates backward during repair or maintenance (e.g., for removing a sheet jam), which would result in deformation and breakage of the electrode terminals.

More preferably, the planar heat generator 22S is attached to the heater support 23 only at its opposed axial ends outboard of the maximum compatible width of recording sheet. Compared to a configuration in which the entire surface of the heat generator is attached to the heater support, such arrangement prevents undesirable transfer of heat from the heat generator 22S to the heater support 23 inboard of the maximum compatible sheet width, resulting in efficient heating of the fuser sleeve 21 with the heat generator 22S while ensuring proper positioning of the heat generator 22S on the heater support 23.

More preferably still, fastening the planar heat generator 22S to the heater support 23 is performed using a thermally resistant, acrylic or silicone-based, double-sided adhesive tape. Use of double-sided adhesive tape facilitates assembly and disassembly of the heat generator 22S with the heater support 23, in particular, during maintenance or repair where a defective heat generator is removed together with an adhesive material from the heater support, followed by connecting a new or repaired heat generator to the heater support with an adhesive placed therebetween.

Referring back again to FIG. 2, the belt tensioner 32 is shown disposed opposite the tubular sleeve holder 27 inside the loop of the fuser sleeve 21 to tighten the fuser sleeve 21. In the present embodiment, the belt tensioner 32 comprises a rotatable tension roller extending across the length of the fuser sleeve 21 in the axial direction, which pulls the fuser sleeve 21 radially outward, away from the rotational axis of the fuser sleeve 21.

Specifically, the tension roller 32 is rotatably held facing the tubular sleeve holder 27 on a side substantially 180° away from and opposite, with respect to the rotational axis of the fuser sleeve 21, where the contact pad 26 forms the fixing nip N. The tension roller 32 has its opposed axial ends each provided with an elastic member such as a tension spring 32*s* that pulls the tension roller 32 against the inner circumference of the fuser sleeve 21 radially away from the fixing nip N, which in turn tightens the fuser sleeve 21 rotating around the tension roller 32 and the sleeve holder 27.

Proper tension thus imparted to the fuser sleeve 21 holds the inner circumference of the sleeve 21 at least partially in contact with the tubular holder 27, resulting in stable rotation of the fuser sleeve 21 as well as uniform spacing between the fuser sleeve 21 and the planar heat generator 22S exposed through the opening 27*a* of the tubular holder 27.

Figure 11:
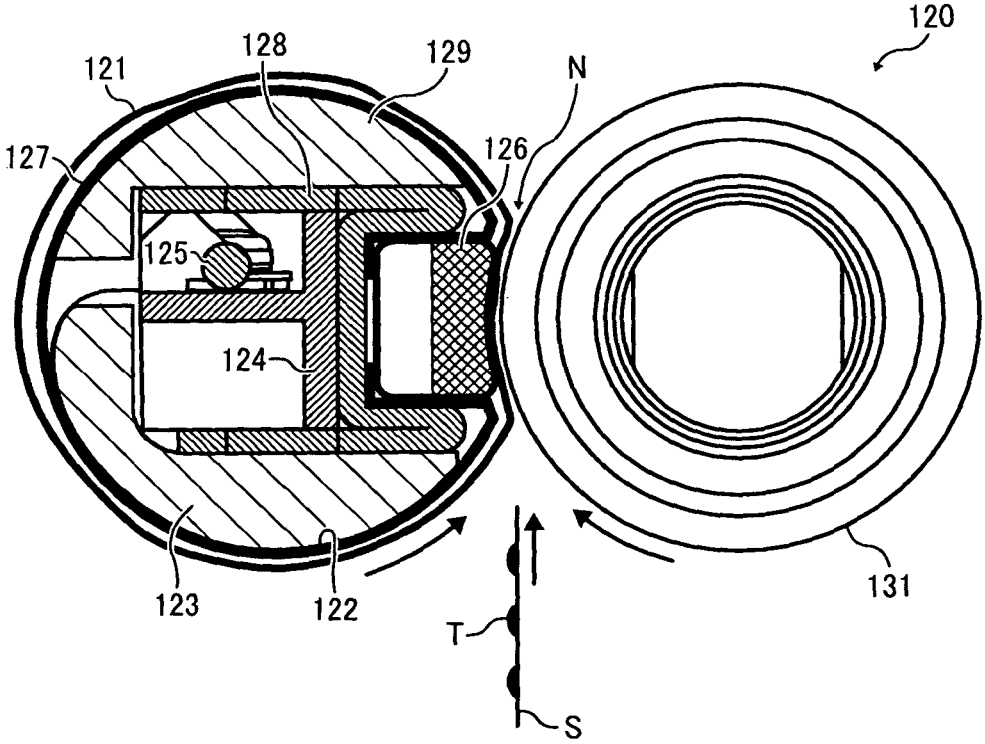
FIG. 11 is an end-on, axial cutaway view schematically illustrating a comparative example of a fixing device.

For comparison purposes, and in order to further facilitate an understanding of the present invention, with additional reference to FIG. 11, consider a comparative example 120 where the fuser assembly does not have any mechanism for adjusting tension on a fuser belt.

As shown in FIG. 11, the overall configuration of the fixing device 120 is similar to that depicted in FIG. 2, including a fuser sleeve 121 paired with a pressure roller 131 pressed against a contact pad 126 via the fuser sleeve 121 to form a fixing nip N, as well as various pieces of fuser equipment disposed inside the loop of the fuser sleeve 121, such as a heater 122, a tubular sleeve holder 127, first and second mounting stays 128 and 124, a heater support 123, a holder support 129, and heater wiring 125, except for a belt tensioner disposed opposite the sleeve holder inside the loop of the fuser sleeve.

In such a configuration, the fuser sleeve 121 tightens against the curvature of the heater holder 123 due to a rotary force or torque from the pressure roller 131 that draws the fuser sleeve 121 into the fixing nip N during operation, which causes its inner surface to touch the heater 122 and the sleeve holder 127. As tension exerted on the fuser sleeve 121 varies, for example, depending on position of the contact pad 126 pressing the fuser sleeve 121 against the pressure roller 131 at the fixing nip N, pressure with which the fuser sleeve 121 contacts the sleeve holder 127 varies with time.

Such variations in contact pressure translate into variations in spacing, and accidental, localized contact between the fuser sleeve 121 and the heater 122 along the circumferential and axial directions. Non-uniform spacing between the fuser sleeve 121 and the heater 122 results in unstable transfer of heat from the heater 122 to the fuser sleeve 121, leading to variations in processing temperature and concomitant failures of the fuser assembly. In particular, unstable heating of the fuser sleeve 121 along the axial direction causes non-uniform distribution of heat across the fixing nip N, which results in insufficient fusing of toner and non-uniform gloss across a printed image. Moreover, localized contact between the fuser sleeve 121 and the heater 122 results in local overheating of the fuser sleeve 121, which aggravate wear and thus affect durability of the elastic member.

In contrast to the comparative example, the fixing device 20 according to this patent specification is highly immune to variations in processing temperature and concomitant failures of the fuser assembly, owing to the tension roller 32 that stabilizes rotation of the fuser sleeve 21, while tightening the fuser sleeve 21 to maintain a stable, uniform contact with the outer surface of the sleeve holder 27.

Upstream of the fixing nip N, stable pressure between the fuser sleeve 21 and the sleeve holder 27 maintains a uniform spacing or distance δ between the inner surface of the fuser sleeve 21 and the outer surface of the heater 22 exposed through the opening 27*a* of the sleeve holder 27. Such uniform spacing δ allows for consistent transfer of heat from the heater 22 to the fuser sleeve 21, resulting in stable and efficient imaging performance of the fixing device 20. In particular, uniform spacing δ between the fuser sleeve 21 and the heat generator 22S along the axial direction allows for uniform distribution of heat across the fixing nip N, resulting in good fusing performance with uniform gloss across a printed image. Moreover, uniform spacing δ prevents localized contact between the fuser sleeve 21 and the heat generator 22S, which would otherwise result in local overheating and concomitant wear of the fuser sleeve 21.

In addition, downstream of the fixing nip N, stable pressure between the fuser sleeve 21 and the sleeve holder 27 ensures the fuser sleeve 21 closely conforms to the curvature of the sleeve holder 27. This facilitates separation of a recording sheet S upon exiting the fixing nip N, where the fuser sleeve 21 exhibits greater curvature at the exit of the fixing nip N than within the fixing nip N.

Preferably, the fixing device 20 has a fixedly mounted spacer or spacers provided between the adjoining surfaces of the fuser sleeve 21 and the tubular sleeve holder 27 to maintain the fuser sleeve 21 at a uniform distance from the heat generator 22. As long as it serves the intended purpose, such spacers may be configured in different sizes, shapes, and positions, as described as follows with reference to FIGS. 12 and 13.

Figure 12:
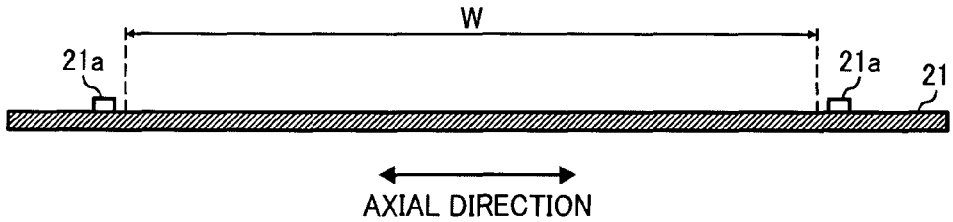
FIG. 12 is a cross-sectional view taken along the width of a fuser belt employed in the fixing device of FIG. 2.

For example, as shown in FIG. 12, which is a cross-sectional view taken along the width of the fuser belt 21, the spacer may be configured as a pair of linear protrusions 21*a* extending along the inner circumference of the fuser sleeve 21. The paired protrusions 21*a* have an identical height not exceeding 1 mm (e.g., approximately 0.1 mm in the present embodiment), and are symmetrically disposed at opposed axial ends of the fuser sleeve 21 outboard of a maximum compatible width W of recording sheet accommodated through the fixing nip N.

Each protrusion 21*a* may be formed of a thin, elongated strip of the same material as the substrate of the fuser sleeve 21, dimensioned to create an even, continuous loop when attached to the inner circumference of the fuser sleeve 21. Alternatively, the protrusion 21*a* may be formed of multiple discrete pieces of suitable material uniform in height, attached to the inner circumference of the fuser sleeve 21 in a linear configuration to create a discontinuous loop. Still alternatively, the protrusion 21*b* may be formed integrally with the fuser sleeve 21 as a part or parts thereof.

During operation, as the rotating fuser sleeve 21 tightens around the sleeve holder 27 with its inner surface pressing against the holder outer surface, the protrusions 21*a* of the fuser sleeve 21 touch those portions of the sleeve holder 27 along the opposed edges of the opening 27*a*, thereby keeping the fuser sleeve 21 apart from the heat generator 22S exposed through the opening 27*a*.

Such provision of the linear protrusions 21*a* along the circumference of the fuser sleeve 21 ensures stable, uniform spacing between the fuser sleeve 21 and the heat generator 22S during operation, which allows more stabilized heating of the fuser sleeve 21 with the heat generator 22S, leading to reliable imaging performance of the fixing device. In particular, symmetrically disposing the parallel protrusions 21*a* at the opposed axial ends allows for uniform spacing between the fuser sleeve 21 and the heat generator 22S along the axial direction, leading to uniform heating of the fuser sleeve 21 and good fusing performance with uniform gloss across a resulting image.

In addition, provision of the linear protrusions 21*a* results in a reduced area of contact, and therefore reduced friction, between the fuser sleeve 21 and the sleeve holder 27. Reduced frictional contact results in reduced load or torque required for the rotary driver to rotate the fuser sleeve 21 around the sleeve holder 27, leading to energy-efficient operation of the fixing device.

Figure 13:
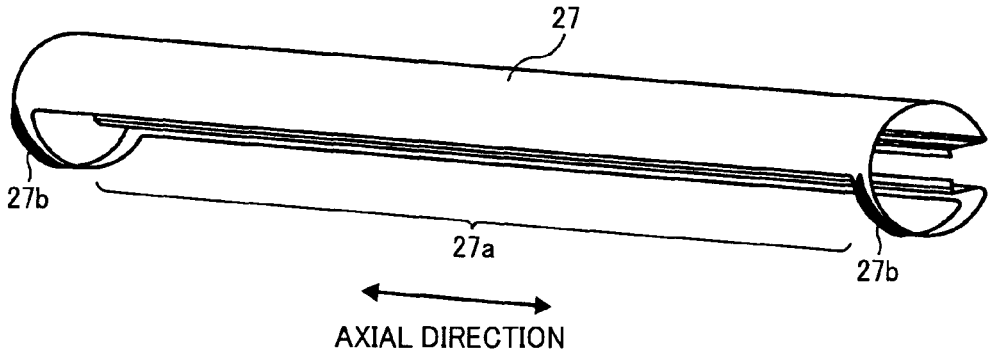
FIG. 13 is a perspective view of the sleeve holder employed in the fixing device of FIG. 2.

Alternatively, as shown in FIG. 13, which is a perspective view of the sleeve holder 27, the spacer may be configured as a pair of linear protrusions 27*b* extending along the outer surface of the sleeve holder 27 around the opening 27*a*. The paired protrusions 27*b* have an identical height not exceeding 1 mm (e.g., approximately 0.1 mm in the present embodiment), and are symmetrically disposed at opposed axial ends of the sleeve holder 27 outboard of a maximum compatible width W of recording sheet accommodated through the fixing nip N.

Each protrusion 27*b* may be formed of a thin, elongated strip of the same material as the sleeve holder 27 attached to the outer circumference of the sleeve holder 27 along the edge of the opening 27*a*. Alternatively, the protrusion 27*b* may be formed of multiple discrete pieces of suitable material uniform in height, attached to the outer circumference of the sleeve holder 27 along the edge of the opening 27*a* in a linear configuration. Still alternatively, the protrusion 27*b* may be formed integrally with the sleeve holder 27 as a part or parts thereof.

During operation, as the rotating fuser sleeve 21 tightens around the sleeve holder 27 with its inner surface pressing against the holder outer surface, the protrusions 27*b* of the sleeve holder 27 touch those portions of the fuser sleeve 21 facing the opposed edges of the opening 27*a*, thereby keeping the fuser sleeve 21 apart from the heat generator 22S exposed through the opening 27*a*.

Such provision of the linear protrusions 27*b* along the circumference of the sleeve holder 27 ensures stable, uniform spacing between the fuser sleeve 21 and the heat generator 22S during operation, which allows more stabilized heating of the fuser sleeve 21 with the heat generator 22S, leading to reliable imaging performance of the fixing device. In particular, symmetrically disposing the parallel protrusions 27*b* at the opposed axial ends allows for uniform spacing between the fuser sleeve 21 and the heat generator 22S along the axial direction, leading to uniform heating of the fuser sleeve 21 and good fusing performance with uniform gloss across a resulting image.

In addition, provision of the linear protrusions 27*b* results in a reduced area of contact, and therefore reduced friction, between the fuser sleeve 21 and the sleeve holder 27. Reduced frictional contact results in reduced load or torque required for the rotary driver to rotate the fuser sleeve 21 around the sleeve holder 27, leading to energy-efficient operation of the fixing device.

More preferably, the fixing device 20 has at least one of the planar heat generator 22S and the heater support 23 partially recessed to accommodate the thickness of an adhesive material, in particular, double-sided adhesive tape, provided to connect the heat generator 22S to the heater support 23.

Figure 14:
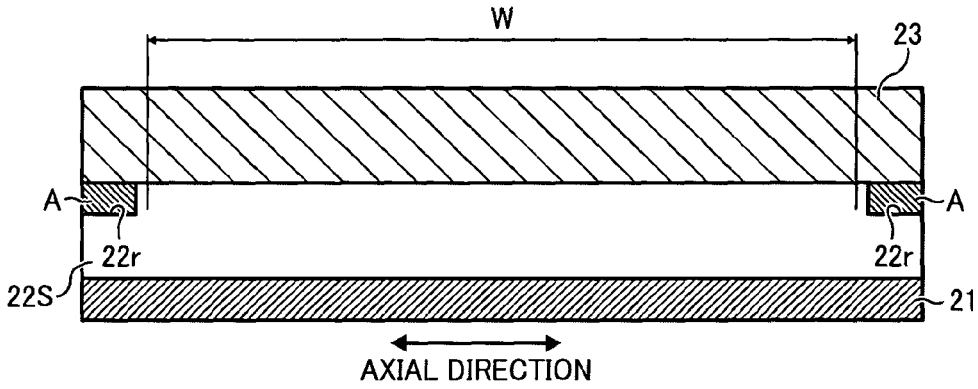
FIG. 14 is a cross-sectional view showing one arrangement of the planar heat generator, taken along the axial direction of the fuser sleeve.

For example, as shown in FIG. 14, which is a cross-sectional view of the interface of the heat generator 22S and the heater support 23 taken along the axial direction of the fuser sleeve 21, a pair of recesses 22*r* may be provided at opposed axial ends of the planar heat generator 22S outboard of a maximum compatible width W of recording sheet, each of which has a depth corresponding to the thickness of double-sided adhesive tape A in use (e.g., approximately 0.1 mm in the present embodiment) and a certain length extending along the circumferential direction (i.e., the direction in which FIG. is drawn).

During assembly, a piece of double-sided adhesive tape A is disposed within the recess 22*r* at each axial end of the heat generator 22S, followed by placing the recessed surface of the heat generator 22S against the heater support 23 so that the adhesive material retains the heat generator 22S in position on the heater support 23. With the recesses 22*r* provided at the interface between the heat generator 22S and the heater support 23, the adhesive tape T rests flush with the adjoining surface of the heat generator 22S.

Figure 15:
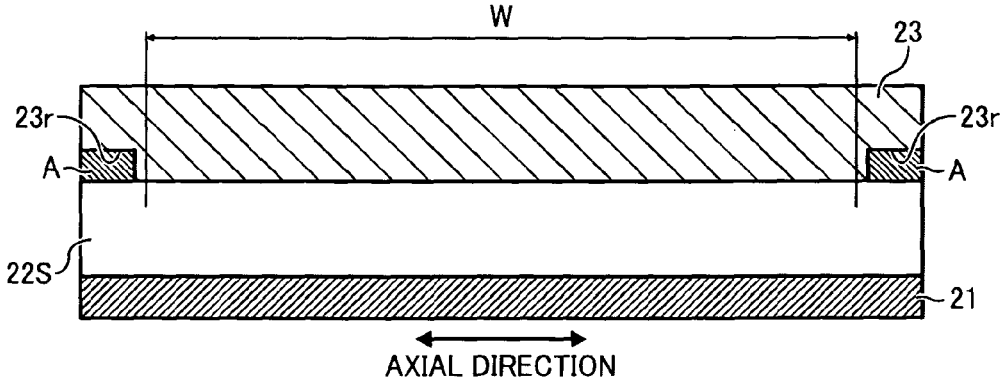
FIG. 15 is a cross-sectional view showing one arrangement of a heater support used with the planar heat generator, taken along the axial direction of the fuser sleeve.

Alternatively, as shown in FIG. 15, which is another cross-sectional view of the interface of the heat generator 22S and the heater support 23 taken along the axial direction of the fuser sleeve 21, a pair of recesses 23*r* may be provided at opposed axial ends of the heater support 23 outboard of a maximum compatible width W of recording sheet, each of which has a depth in the circumferential direction corresponding to the thickness of double-sided adhesive tape A in use (e.g., approximately 0.1 mm in the present embodiment) and a certain length extending along the circumferential direction (i.e., the direction in which FIG. is drawn).

During assembly, a piece of double-sided adhesive tape A is disposed within the recess 23*r* at each axial end of the heater support 23, followed by placing the heat generator 22S against the recessed surface of the heater support 23 so that the adhesive material retains the heat generator 22S in position on the heater support 23. With the recesses 23*r* provided at the interface between the heat generator 22S and the heater support 23, the adhesive tape T rests flush with the adjoining surface of the heat generator 22S.

In a configuration where the heat generator and the heater support each has a completely flat interfacial surface, disposing adhesive at their interface causes swelling or deformation on the surface of the heat generator facing the fuser sleeve depending on the thickness of adhesive in use. Such irregularities on the surface of the heat generator result in non-uniform spacing between the heat generator and the fuser sleeve, leading to reduced thermal efficiency and non-uniform heat distribution along the axial direction of the fuser sleeve.

By contrast, with the arrangements of FIGS. 14 and 15, attaching the heat generator 22S to the heater support 23 may be performed without causing irregularities on the surface of the heat generator 22S facing the fuser sleeve 21. A flat, uniform surface of the heat generator 22S means a uniform spacing or contact between the heat generator 22S and the fuser sleeve 21 inboard of the maximum compatible width W of recording sheet, leading to efficient, uniform heating along the axial direction of the fuser sleeve 21.

Thus, the fixing device 20 according to this patent specification incorporates an energy-efficient, high-speed, durable fuser assembly, wherein the combination of the fuser sleeve 21 and the planar heat generator 22S, each exhibiting a low heat capacity, heats the fixing nip N promptly and efficiently to provide fixing with short warm-up time and first-print time, and wherein the resin-based heat generator 22S exhibits high immunity to wear and tear when repeatedly bent and strained due to vibration or rotation transmitted from the pressure roller 31, leading to stable operation of the fuser assembly over an extended period of time.

The fixing device 20 provides excellent imaging performance with uniform gloss across a resulting image, owing to the belt tensioner 32 that tightens the fuser sleeve 21 so as to maintain the sleeve 21 in contact or close proximity with the heater to equalize distribution of heat over the sleeve 21 along the axial direction. Further, provision of the tubular sleeve holder 27 as well as the optional, insulative support 29 ensures stable rotation of the fuser sleeve 21, allowing for reliable imaging performance in high speed applications. The image forming apparatus incorporating the fixing device benefits from these and other features of the fuser assembly according to this patent specification.

It should be noted that although in the embodiment depicted above the fixing device 20 employs the single spring-loaded tension roller 32 that pulls the fuser sleeve 21 radially outward opposite the fixing nip N, the belt tensioner according to this patent specification may be configured in any structure disposed inside the loop of the fuser sleeve to properly tighten the fuser sleeve.

Figure 16:
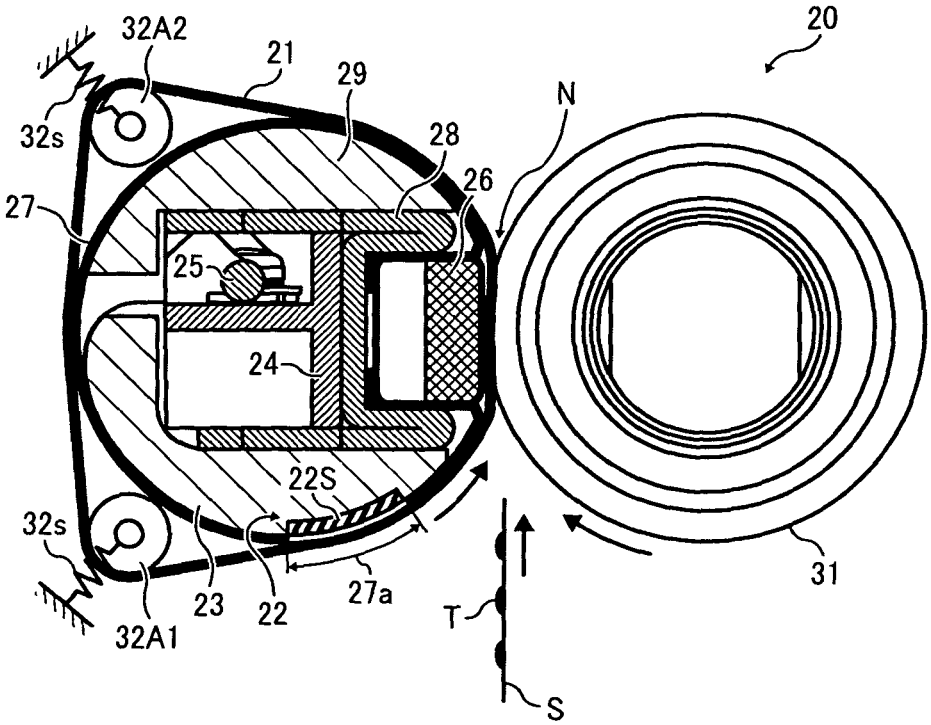
FIG. 16 schematically illustrates a further embodiment of the fixing device according to this patent specification.

For example, the belt tensioner may be a set of multiple tension rollers disposed to tighten the fuser sleeve at different positions along the circumferential direction. FIG. 16 schematically illustrates such embodiment of the fixing device 20.

As shown in FIG. 16, the overall configuration of the present embodiment is similar to that depicted in FIG. 2, except that the belt tensioner comprises a pair of first and second, rotatable tension rollers 32A1 and 32A2, instead of a single tension roller, each extending across the length of the fuser sleeve 21 in the axial direction, and that the planar heat generator 22S is positioned at an acute angle from, and upstream of, the fixing nip N along the circumferential direction.

Specifically, inside the loop of the fuser sleeve 21, the tension rollers 32A are rotatably held facing the tubular sleeve holder 27 apart from where the contact pad 26 forms the fixing nip N. Each tension roller 32A has its opposed axial ends provided with an elastic member such as a tension spring 32*s* that pulls the tension roller 32A against the inner circumference of the fuser sleeve 21 radially away from the fixing nip N, which in turn maintains proper tension of the fuser sleeve 21 rotating around the tension roller 32 and the tubular sleeve holder 27.

More specifically, the first tension roller 32A1 is positioned upstream of the fixing nip N, loaded with the spring 32*s* away from the sleeve holder 27 at a particular angle (e.g., diagonally left downward in FIG. 16), with respect to the rotational axis of the fuser sleeve 21, from the fixing nip N. The second tension roller 32A2 is positioned downstream of the fixing nip N, loaded with the spring 32*s* away from the sleeve holder 27 at a particular angle (e.g., diagonally left upward in FIG. 16), with respect to the rotational axis of the fuser sleeve 21, from the fixing nip N.

As is the case with the embodiment depicted in FIG. 2, the fixing device 20 according to this patent specification is highly immune to variations in processing temperature and concomitant failures of the fuser assembly, owing to the set of tension rollers 32A that stabilizes rotation of the fuser sleeve 21, while tightening the fuser sleeve 21 to maintain a stable, uniform contact with the outer surface of the sleeve holder 27.

Upstream of the fixing nip N, the first tension roller 32A1 maintains stable pressure between the fuser sleeve 21 and the sleeve holder 27, which in turn maintains a uniform spacing or distance δ between the inner surface of the fuser sleeve 21 and the outer surface of the heater 22 exposed through the opening 27*a* of the sleeve holder 27. Such uniform spacing δ allows for consistent transfer of heat from the heater 22 to the fuser sleeve 21, resulting in stable and efficient imaging performance of the fixing device 20. In particular, uniform spacing δ between the fuser sleeve 21 and the heat generator 22S along the axial direction allows for uniform distribution of heat across the fixing nip N, resulting in good fusing performance with uniform gloss across a printed image. Moreover, uniform spacing δ prevents localized contact between the fuser sleeve 21 and the heat generator 22S, which would otherwise result in local overheating and concomitant wear of the fuser sleeve 21.

In addition, downstream of the fixing nip N, the second tension roller 32A2 maintains stable pressure between the fuser sleeve 21 and the sleeve holder 27, which in turn ensures the fuser sleeve 21 closely conforms to the curvature of the sleeve holder 27. This facilitates separation of a recording sheet S upon exiting the fixing nip N, where the fuser sleeve 21 exhibits greater curvature at the exit of the fixing nip N than within the fixing nip N.

Moreover, provision of the multiple tension rollers 32A reduces an area of contact, and therefore friction, between the fuser sleeve 21 and the tubular sleeve holder 27. Reduced frictional contact results in reduced load or torque required for the rotary driver to rotate the fuser sleeve 21 around the sleeve holder 27, leading to increased durability of the fuser sleeve 21 and energy-efficient operation of the fixing device.

It should also be noted that although in several embodiments depicted above the fixing device 20 has the fuser sleeve 21 equipped with the tubular sleeve holder 27, alternatively the sleeve holder 27 may be omitted so that the fuser sleeve 21 is entrained around the heater support 23, the insulative support 29, and the belt tensioner 32 with its inner circumference sliding against the heater 22. In such cases, the fixing device 20 can provide thermally efficient, reliable imaging performance, wherein provision of the belt tensioner 32 for tightening the fuser sleeve 21 maintains the fuser sleeve 21 in contact with the heater 22, resulting in stable conduction of heat from the heater 22 to the fuser sleeve 21 to obtain uniform distribution of heat over the fuser sleeve 21, in particular, along the axial direction, which allows for good fusing performance with uniform gloss across a resulting image.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

an endless fuser belt looped into a generally cylindrical configuration extending in an axial direction thereof for rotation in a circumferential direction thereof;

a contact member extending in the axial direction inside the loop of the fuser belt;

a pressure member extending in the axial direction with the belt interposed between the contact member and the pressure member, the pressure member being pressed against the contact member through the fuser belt to form a fixing nip through which a recording medium is passed under heat and pressure;

a heater disposed inside the loop of the fuser belt adjacent to an inner circumference of the fuser belt to heat the fuser belt;

a heater support disposed inside the loop of the fuser belt to hold the heater in position; and a belt tensioner disposed inside the loop of the fuser belt to tighten the belt so as to maintain the belt in contact or close proximity with the heater.

2. The fixing device according to claim 1, wherein the belt tensioner is positioned opposite to the fixing nip across a rotational axis of the fuser belt.

3. The fixing device according to claim 1, wherein the belt tensioner includes multiple elastic members positioned around a rotational axis of the fuser belt.

4. The fixing device according to claim 1, wherein the belt tensioner comprises a spring-loaded tension roller positioned opposite to the fixing nip across a rotational axis of the fuser belt to pull the fuser belt radially outward, away from the rotational axis of the fuser belt.

5. The fixing device according to claim 1, wherein the belt tensioner comprises multiple spring-loaded tension rollers positioned around a rotational axis of the fuser belt, each to pull the fuser belt radially outward and away from the rotational axis of the fuser belt.

6. The fixing device according to claim 1, wherein the heater comprises a flexible, planar heat generator extending in the axial and circumferential directions, the generator including:

an electrically insulative substrate;

a resistive heating layer of heat-resistant resin with conductive particles dispersed therein, disposed on the substrate to generate heat when electrified; and an electrode layer of conductive material, disposed adjoining the resistive heating layer on the substrate to supply the resistive heating layer with electricity.

7. The fixing device according to claim 1, further comprising a tubular holder extending in the axial direction opposite the belt tensioner and inside the loop of the fuser belt to retain the fuser belt in its generally cylindrical shape, the heater being exposed to the inner circumference of the fuser belt through an opening defined in the tubular holder, the belt tensioner holding the inner circumference of the belt at least partially in contact with the tubular holder.

8. The fixing device according to claim 7, wherein the belt tensioner is positioned along an outer circumference of the tubular holder opposite to the fixing nip across a rotational axis of the fuser belt.

9. The fixing device according to claim 7, wherein the belt tensioner includes multiple elastic members positioned along an outer circumference of the tubular holder around a rotational axis of the fuser belt.

10. The fixing device according to claim 7, wherein a linear protrusion of uniform thickness extending in the circumferential direction is provided on an inner circumference of the fuser belt.

11. The fixing device according to claim 10, wherein the linear protrusion is provided at each of opposed axial ends of the fuser belt outboard of a maximum compatible width of recording sheet that the fixing device accommodates through the fixing nip.

12. The fixing device according to claim 7, wherein an outer surface of the tubular holder has a linear protrusion of a uniform thickness extending along an edge of the opening in the tubular holder.

13. The fixing device according to claim 12, wherein the linear protrusion is provided at each of opposed axial ends of the tubular holder outboard of a maximum compatible width of recording sheet that the fixing device accommodates through the fixing nip.

14. An image forming apparatus comprising:

an electrophotographic imaging unit to form a toner image on a recording medium; and a fixing device to fix the toner image in place on the recording medium, the fixing device including:

an endless fuser belt looped into a generally cylindrical configuration extending in an axial direction thereof for rotation in a circumferential direction thereof;

a contact member extending in the axial direction inside the loop of the fuser belt;

a pressure member extending in the axial direction with the belt interposed between the contact member and the pressure member, the pressure member being pressed against the contact member through the fuser belt to form a fixing nip through which the recording medium is passed under heat and pressure;

a heater disposed inside the loop of the fuser belt adjacent to an inner circumference of the fuser belt to heat the fuser belt;

a heater support disposed inside the loop of the fuser belt to hold the heater in position; and a belt tensioner disposed inside the loop of the fuser belt to tighten the belt so as to maintain the belt in contact or close proximity with the heater.

* * * * *